US012398956B2

(12) United States Patent
Hirokawa et al.

(10) Patent No.: US 12,398,956 B2
(45) Date of Patent: Aug. 26, 2025

(54) HEAT EXCHANGER

(71) Applicant: DAIKIN INDUSTRIES, LTD., Osaka (JP)

(72) Inventors: Tomoki Hirokawa, Osaka (JP); Yoshiyuki Matsumoto, Osaka (JP); Tooru Andou, Osaka (JP); Hideyuki Kusaka, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 306 days.

(21) Appl. No.: 17/548,749

(22) Filed: Dec. 13, 2021

(65) Prior Publication Data

US 2022/0099374 A1 Mar. 31, 2022

Related U.S. Application Data

(63) Continuation of application No. PCT/JP2020/019594, filed on May 18, 2020.

(30) Foreign Application Priority Data

Jun. 13, 2019 (JP) ..... 2019-110322

(51) Int. Cl.
*F28F 9/02* (2006.01)
*F28D 1/053* (2006.01)
*F28F 1/02* (2006.01)

(52) U.S. Cl.
CPC ..... *F28D 1/053* (2013.01); *F28F 1/02* (2013.01); *F28F 9/02* (2013.01)

(58) Field of Classification Search
CPC .... F28D 1/053; F28D 1/0471; F28D 1/05391; F28F 1/02; F28F 9/02; F28F 1/32; F28F 9/0275; F28F 9/0209; F28F 2215/12
See application file for complete search history.

(56) References Cited

U.S. PATENT DOCUMENTS 2,733,899 A * 2/1956 Lehmann ..... F28F 9/0217 165/150
5,078,206 A 1/1992 Goetz, Jr.
(Continued)

FOREIGN PATENT DOCUMENTS

DE 102006046061 A1 4/2007
EP 3051244 A1 8/2016
(Continued)

OTHER PUBLICATIONS

Extended European Search Report issued in corresponding European Patent Application No. 20821723.2, mailed Jun. 20, 2022 (8 pages).
(Continued)

*Primary Examiner* — Harry E Arant
(74) *Attorney, Agent, or Firm* — Osha Bergman Watanabe & Burton LLP

(57) ABSTRACT

A heat exchanger includes: heat transfer tubes disposed along a predetermined direction; and a header that retains longitudinal ends of the heat transfer tubes. The header includes: a first member including a main wall portion that has through holes through which the longitudinal ends respectively pass; a second member defining insertion spaces that communicate with the heat transfer tubes at the longitudinal ends; and a third member facing the longitudinal ends. The second member includes: a pair of side plates disposed in a width direction of the header and that define the insertion spaces therebetween; and a partition plate connected to the pair of side plates and that separates adjacent ones of the insertion spaces.

13 Claims, 19 Drawing Sheets

(56) References Cited

U.S. PATENT DOCUMENTS

| | | | | |
|---|---|---|---|---|
| 5,366,007 | A | 11/1994 | Hutto et al. | |
| 2003/0188857 | A1* | 10/2003 | Kawakubo | F28F 9/0243 165/174 |
| 2009/0126920 | A1* | 5/2009 | Demuth | F28D 1/0478 165/173 |
| 2009/0266104 | A1* | 10/2009 | Ichiyanagi | F28F 9/0253 165/173 |
| 2017/0314792 | A1 | 11/2017 | Jindou et al. | |
| 2020/0018528 | A1 | 1/2020 | Akaiwa et al. | |

FOREIGN PATENT DOCUMENTS

| | | | | |
|---|---|---|---|---|
| FR | 2909754 | A1 * | 6/2008 | F28F 9/0221 |
| JP | H05-025185 | U | 4/1993 | |
| JP | 2007147128 | A | 6/2007 | |
| JP | 2007-170718 | A | 7/2007 | |
| JP | 2007278556 | A | 10/2007 | |
| JP | 2010-249343 | A | 11/2010 | |
| JP | 2011099664 | A | 5/2011 | |
| JP | 2011127831 | A | 6/2011 | |
| JP | 2015-113983 | A | 6/2015 | |
| JP | 2016-095086 | A | 5/2016 | |
| JP | 2016-95087 | A | 5/2016 | |
| WO | 2015/046275 | A1 | 4/2015 | |
| WO | 2018078746 | A1 | 5/2018 | |

OTHER PUBLICATIONS

International Preliminary Report on Patentability issued in corresponding International Application No. PCT/JP2020/019594 mailed on Dec. 23, 2021 (7 pages).

Fumio Yamaguchi, Know-it-all series: Easy-to-understand 'Press Working book', The Nikkan Kogyo Shimbun, Ltd., 2019, p. 36-37, with translation (4 pages).

International Search Report issued in corresponding International Application No. PCT/JP2020/019594 mailed Jul. 7, 2020 (3 pages).

* cited by examiner

HEAT EXCHANGER

TECHNICAL FIELD

The present disclosure relates to a heat exchanger.

BACKGROUND

A heat exchanger that has been used includes a header extending in a vertical direction, and a plurality of flat tubes extending in a direction orthogonal to the longitudinal direction of the header and inserted into the header, and is configured to exchange heat between a refrigerant flowing through the flat tubes and air flowing outside the flat tubes.

Patent Document 1 discloses that to achieve a microchannel heat exchanger (MCHX) that includes flat tubes arranged in rows and in columns separated from one another in a header that connects the rows of the flat tubes together, a heat sink member extruded in the direction of wind (in the widthwise direction of the flat tubes) is used as a member defining insertion spaces into each of which the associated flat tubes are inserted. This heat sink member and a plate-shaped member into which end portions of the flat tubes are to be inserted are joined together to form a connecting header, thereby inserting the flat tubes into the header without bringing the end portions of the flat tubes into contact with the inner wall of the header. This can prevent the flat tubes from being disconnected from the header, and prevent holes of flat perforated tubes from being filled with brazing alloy, during brazing.

Patent Literature

Patent Document 1: Japanese Unexamined Patent Publication No. 2016-95086

SUMMARY

One or more embodiments of the present disclosure are directed to a heat exchanger including: a plurality of heat transfer tubes (13) arranged in multiple columns along a predetermined direction; and a header (21, 24) configured to retain first longitudinal end portions of the heat transfer tubes (13). The header (21, 24) includes: a first member (40, 110) including a main wall portion (41, 111) having a plurality of through holes (42, 112) through each of which the first longitudinal end portion of an associated one of the heat transfer tubes (13) passes; a second member (50, 120) defining a plurality of insertion spaces (70, 160) that each communicate with the first longitudinal end portion of at least one of the heat transfer tubes (13); and a third member (60, 130) facing the first longitudinal end portions of the heat transfer tubes (13) that have respectively passed through the through holes (42, 112). The second member (50, 120) includes: a pair of side plates (51, 121) defining the insertion spaces (70, 160) therebetween in a width direction of the header (21, 24); and at least one partition plate (52, 122) connected to the pair of side plates (51, 121) to separate the insertion spaces (70, 160) from each other.

DETAILED DESCRIPTION

Embodiments of the present disclosure will be described below with reference to the drawings. The embodiments below are merely exemplary ones in nature, and are not intended to limit the scope, applications, or use of the invention.

Configuration of Heat Exchanger

Figure 1:
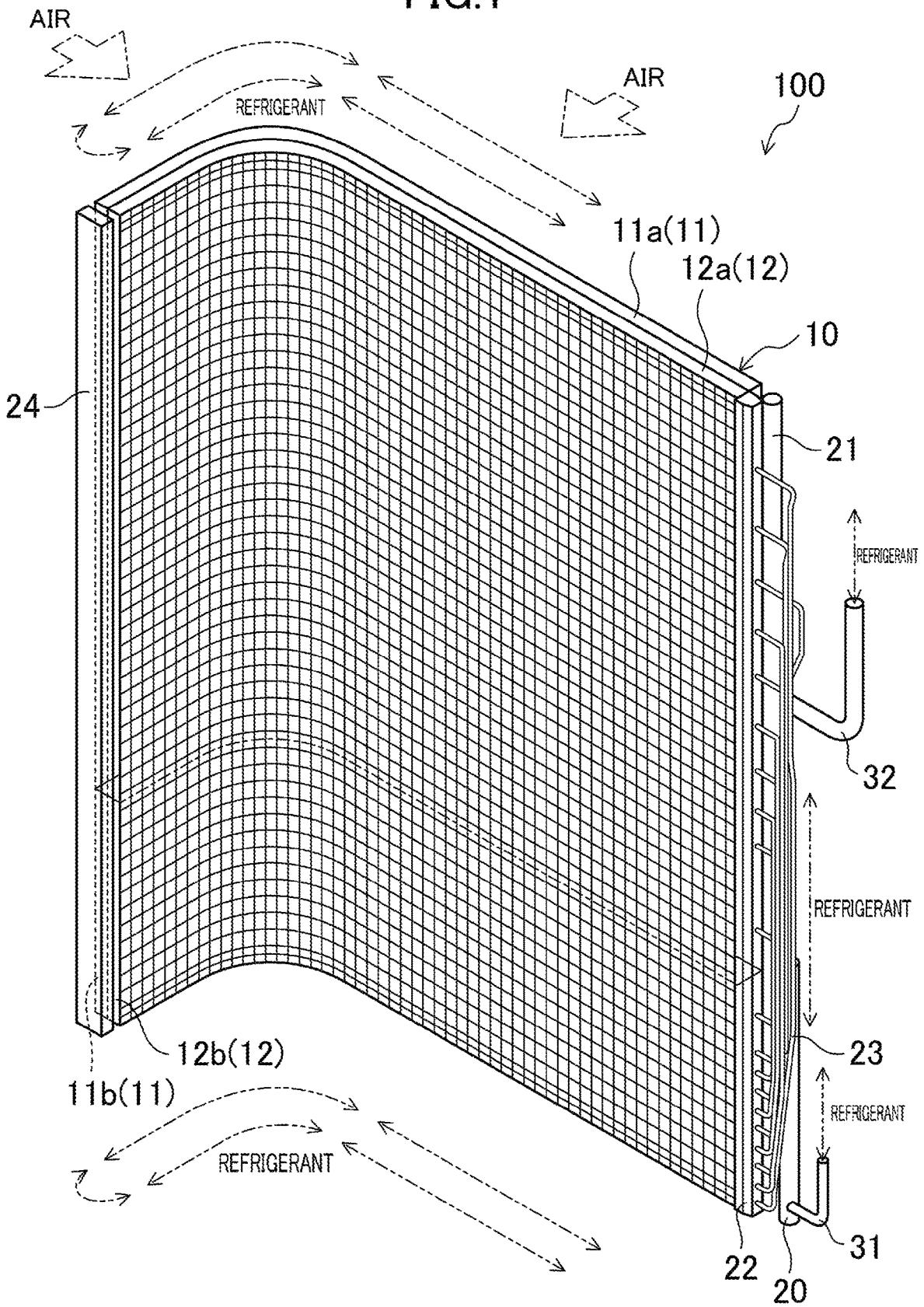
FIG. 1 is a schematic diagram illustrating a heat exchanger according to one or more embodiments.

FIG. 1 is a schematic diagram illustrating a heat exchanger (100) according to one or more embodiments.

Figure 2:
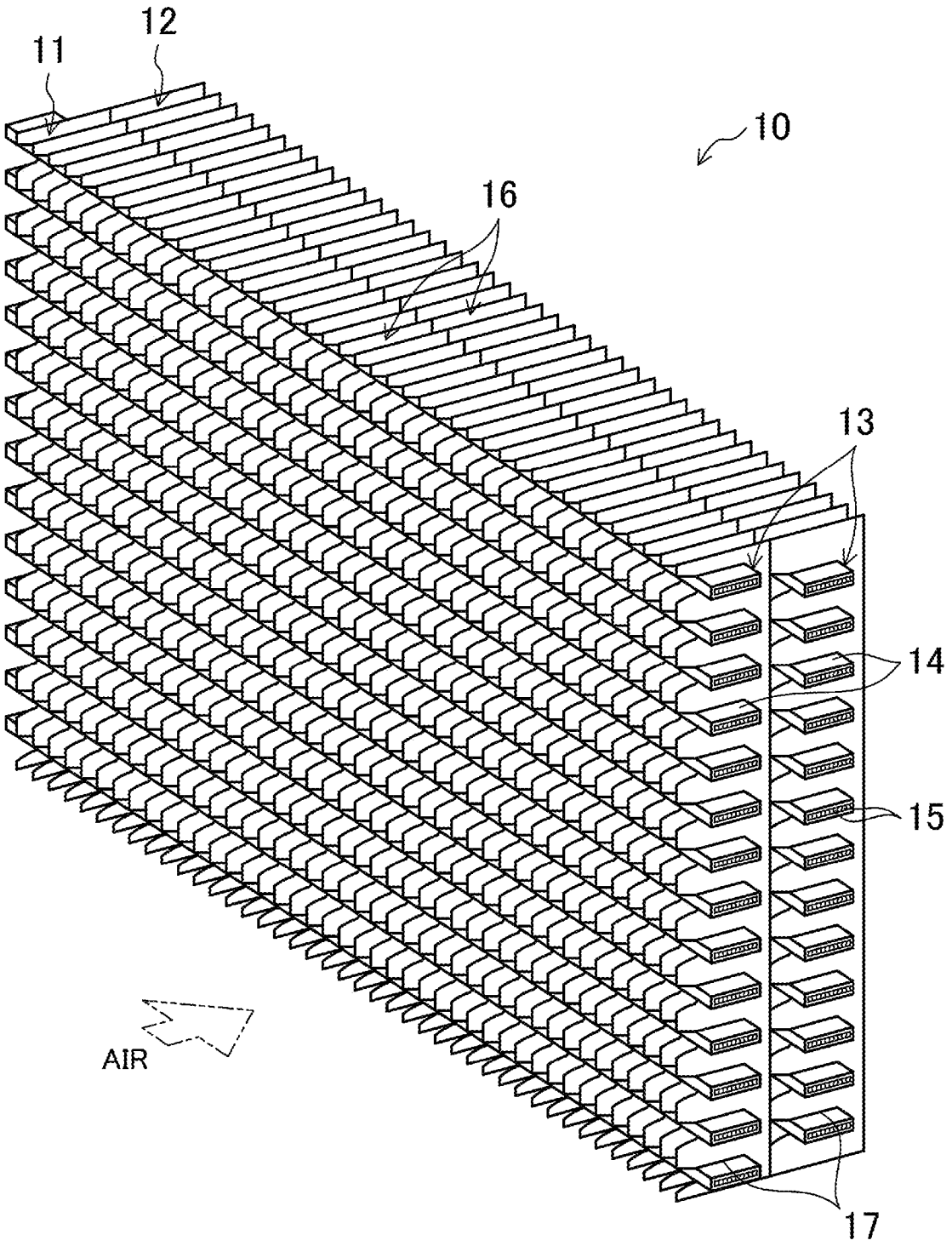
FIG. 2 is an enlarged view of a heat exchange part of the heat exchanger illustrated in FIG. 1.

FIG. 2 is an enlarged view of a heat exchange part of the heat exchanger (100) illustrated in FIG. 1.

The heat exchanger (100) condenses or evaporates a refrigerant using air as a cooling source or a heating source, and is used as, for example, a heat exchanger forming part of a refrigerant circuit of a vapor compression refrigeration apparatus. Examples of the refrigerant circulating through the refrigerant circuit include a carbon dioxide refrigerant.

Note that in the following description, unless otherwise specified, terms related to directions and planes indicate directions and planes with respect to a state where the heat exchanger (100) is placed as an outdoor heat exchanger in an outdoor unit of an air conditioner.

As illustrated in FIG. 1, the heat exchanger (100) mainly includes a heat exchange part (10) configured to exchange heat between outdoor air and the refrigerant, a connecting header (24) provided near a first end (in these embodiments, the left front end) of the heat exchange part (10), and a refrigerant flow divider (20), an inlet/outlet header (21), and an intermediate header (22) provided near a second end (in these embodiments, the right end) of the heat exchange part (10). The refrigerant flow divider (20), inlet/outlet header (21), intermediate header (22), connecting header (24), and heat exchange part (10) of the heat exchanger (100) are made of, for example, aluminum or an aluminum alloy. These members are joined together by brazing, such as furnace brazing.

The heat exchange part (10) includes a windward heat exchange section (11) forming a windward portion of the heat exchanger (100), and a leeward heat exchange section (12) forming a leeward portion of the heat exchanger (100). The heat exchange sections (11), (12) are arranged in a plurality of (e.g., two) rows adjacent to each other in a direction in which outdoor air produced through driving of an outdoor fan (not shown) passes through the heat exchanging part (10) (the tube row direction). In other words, a section of the heat exchange part (10) located windward with respect to the direction in which outdoor air passes through the heat exchange part (10) is the windward heat exchange section (11), and a section of the heat exchange part (10) located leeward of the windward heat exchange section (11) is the leeward heat exchange section (12). The windward heat exchange section (11) includes a windward main heat exchange subsection (11*a*) forming part of an upper portion of the heat exchanger (100), and a windward subsidiary heat exchange subsection (11*b*) forming part of a lower portion of the heat exchanger (100). The leeward heat exchange section (12) includes a leeward main heat exchange subsection (12*a*) forming part of the upper portion of the heat exchanger (100), and a leeward subsidiary heat exchange subsection (12*b*) forming part of the lower portion of the heat exchanger (100).

As illustrated in FIG. 2, the heat exchange part (10) includes a plurality of heat transfer tubes (13) configured as, for example, flat tubes, and a plurality of heat transfer fins (16) configured as, for example, insertion fins.

Each heat transfer tube (13) is made of, for example, aluminum or an aluminum alloy, and is a flat perforated tube having flat surfaces (14) serving as heat transfer surfaces, and multiple small internal channels (15) through each of which the refrigerant flows. The heat transfer tubes (13) are arranged in multiple columns so as to be spaced apart from one another in a predetermined tube column direction, while adjacent ones of the flat surfaces (14) face each other. The heat transfer tubes (13) are arranged in a plurality of (e.g., two) rows adjacent to each other in a staggered manner along the tube row direction (in these embodiments, the direction in which outdoor air passes through the heat exchange part (10)) that intersects each of the tube column direction and the longitudinal direction of the heat transfer tubes (13). The heat transfer tubes (13) are connected at their respective first longitudinal end portions (in these embodiments, their respective left front end portions) to the connecting header (24), and at their respective second longitudinal end portions (in these embodiments, their respective right end portions) to the inlet/outlet header (21) or the intermediate header (22). In other words, the heat transfer tubes (13) are arranged in multiple columns and a plurality of rows and between a combination of the inlet/outlet header (21) and the intermediate header (22) and the connecting header (24). In this case, the flat surfaces (14) of the heat transfer tubes (13) face in the vertical direction. Thus, the tube column direction means the vertical direction, and the longitudinal direction of the heat transfer tubes (13) means the horizontal direction.

The heat transfer fins (16) are made of, for example, aluminum or an aluminum alloy, and are spaced apart from one another along the longitudinal direction of the heat transfer tubes (13). The heat transfer fins (16) each have multiple cut-outs (17) extending along the tube row direction that intersects each of the tube column direction and the longitudinal direction of the heat transfer tubes (13). The heat transfer tubes (13) are each inserted into, and retained in, the associated cut-outs (17). In this case, since the tube column direction means the vertical direction, and the longitudinal direction of the heat transfer tubes (13) means the horizontal direction, the tube row direction means a horizontal direction intersecting the longitudinal direction of the heat transfer tubes (13), and corresponds to the direction in which outdoor air passes through the heat exchange part (10). The cut-outs (17) are each elongated horizontally from one edge of the associated heat transfer fin (16) in the tube row direction (in these embodiments, a windward edge of the fin with respect to the direction in which outdoor air passes through the heat exchange part (10)).

The heat transfer tubes (13) are divided into heat transfer tube groups respectively forming the windward main heat exchange subsection (11*a*), the windward subsidiary heat exchange subsection (11*b*), the leeward main heat exchange subsection (12*a*), and the leeward ward subsidiary heat exchange subsection (12*b*). The heat transfer fins (16) are divided into fin groups respectively forming a windward row and a leeward row. The windward row is shared by the windward main heat exchange subsection (11*a*) and the windward subsidiary heat exchange subsection (11*b*). The leeward row is shared by the leeward main heat exchange subsection (12*a*) and the leeward subsidiary heat exchange subsection (12*b*).

Note that the heat exchange part (10) should not be limited to the fin-insertion type heat exchange part including the insertion fins as the heat transfer fins (16) as described above, and may be a corrugated-fin type heat exchange part including a plurality of corrugated fins as the heat transfer fins (16).

The refrigerant flow divider (20) (see FIG. 1) is connected between a liquid refrigerant pipe (31) and a lower portion of the inlet/outlet header (21). The refrigerant flow divider (20) is, for example, a member made of aluminum or an aluminum alloy and extending in the vertical direction (tube column direction). The refrigerant flow divider (20) is configured to divert a portion of the refrigerant flowing thereinto through the liquid refrigerant pipe (31) to guide the diverted portion of the refrigerant to the lower portion of the inlet/outlet header (21), or to merge the flowing refrigerant through the lower portion of the inlet/outlet header (21) to guide the combined refrigerant to the liquid refrigerant pipe (31).

The inlet/outlet header (21) is provided on a portion of the windward heat exchange section (11) near the second end (in these embodiments, the right end) of the heat exchange part (10). The inlet/outlet header (21) is connected to the second longitudinal end portions (in these embodiments, the right end portions) of the heat transfer tubes (13) (flat tubes) that form the windward heat exchange section (11). The inlet/outlet header (21) is, for example, a member made of aluminum or an aluminum alloy and extending in the vertical direction (tube column direction). The internal space of the inlet/outlet header (21) is partitioned into upper and lower spaces by a baffle (not shown). The upper space of the inlet/outlet header (21) communicates with the second end portions (in these embodiments, the right end portions) of the heat transfer tubes (13) that form the windward main heat exchange subsection (11*a*). The lower space of the inlet/outlet header (21) communicates with the second end portions (in these embodiments, the right end portions) of the heat transfer tubes (13) that form the windward subsidiary heat exchange subsection (11*b*). An upper portion of the inlet/outlet header (21) is connected to a gas refrigerant pipe (32). This allows the refrigerant to be exchanged between the windward main heat exchange subsection (11*a*) and the gas refrigerant pipe (32). The lower portion of the inlet/outlet header (21) is connected to the refrigerant flow divider (20). This allows the refrigerant to be exchanged between the windward subsidiary heat exchange subsection (11*b*) and the refrigerant flow divider (20).

The intermediate header (22) is provided on a portion of the leeward heat exchange section (12) near the second end (in these embodiments, the right end) of the heat exchange part (10). The intermediate header (22) is connected to the second longitudinal end portions (in these embodiments, the right end portions) of the heat transfer tubes (13) that form the leeward heat exchange section (12). The intermediate header (22) is, for example, a member made of aluminum or an aluminum alloy and extending in the vertical direction (tube column direction). The internal space of the intermediate header (22) is partitioned into upper and lower spaces by a baffle (not shown). The upper space communicates with the second end portions (in these embodiments, the right end portions) of the heat transfer tubes (13) that form the leeward main heat exchange subsection (12*a*). The lower space communicates with the second end portions (in these embodiments, the right end portions) of the heat transfer tubes (13) that form the leeward subsidiary heat exchange subsection (12*b*). The upper and lower spaces of the intermediate header (22) are each partitioned into a plurality of subspaces by baffles (not shown) in accordance with the number of paths of the heat exchange part (10). The upper and lower spaces of the intermediate header (22) communicate with each other through an intermediate communication pipe (23) and/or any other appropriate member. The intermediate header (22) allows the refrigerant to be exchanged between the leeward main heat exchange subsection (12*a*) and the leeward subsidiary heat exchange subsection (12*b*).

The connecting header (24) is provided near the first end (in these embodiments, the left front end) of the heat exchange part (10). The connecting header (24) is connected to the first end portions (in these embodiments, the left front end portions) of the heat transfer tubes (13) forming the heat exchange part (10). The connecting header (24) is, for example, a member made of aluminum or an aluminum alloy and extending in the vertical direction (tube column direction). The connecting header (24) has a connection path configured to allow the first end portions (in these embodiments, the left front end portions) of the heat transfer tubes (13) that form the windward heat exchange section (11) to communicate with the associated first end portions (in these embodiments, the left front end portions) of the heat transfer tubes (13) that form the leeward heat exchange section (12). Thus, the first longitudinal end portions (in these embodiments, the left front end portions) of each pair of the heat transfer tubes (13) adjacent to each other in the tube row direction communicate with each other. In other words, the connecting header (24) allows the refrigerant to be exchanged between the windward heat exchange section (11) and the leeward heat exchange section (12).

If the heat exchanger (100) having the foregoing configuration functions as an evaporator for the refrigerant, the refrigerant flowing from the liquid refrigerant pipe (31) into the heat exchanger (100) is guided through the refrigerant flow divider (20) and the lower portion of the inlet/outlet header (21) to the windward subsidiary heat exchange subsection (11*b*) as indicated by the arrows indicating the flow of the refrigerant in FIG. 1. The refrigerant that has passed through the windward subsidiary heat exchange subsection (11*b*) is guided through a lower portion of the connecting header (24) to the leeward subsidiary heat exchange subsection (12*b*). The refrigerant that has passed through the leeward subsidiary heat exchange subsection (12*b*) is guided through the intermediate header (22) to the leeward main heat exchange subsection (12*a*). The refrigerant that has passed through the leeward main heat exchange subsection (12*a*) is guided through an upper portion of the connecting header (24) to the windward main heat exchange subsection (11*a*). The refrigerant that has passed through the windward main heat exchange subsection (11*a*) flows out of the heat exchanger (100) through the upper portion of the inlet/outlet header (21) to the gas refrigerant pipe (32). In the course of such refrigerant flow, the refrigerant evaporates through heat exchange with outdoor air.

If the heat exchanger (100) functions as a radiator for the refrigerant, the refrigerant flowing from the gas refrigerant pipe (32) into the heat exchanger (100) is guided through the upper portion of the inlet/outlet header (21) to the windward main heat exchange subsection (11*a*) as indicated by the arrows indicating the flow of the refrigerant in FIG. 1. The refrigerant that has passed through the windward main heat exchange subsection (11*a*) is guided through the upper portion of the connecting header (24) to the leeward main heat exchange subsection (12*a*). The refrigerant that has passed through the leeward main heat exchange subsection (12*a*) is guided through the intermediate header (22) to the leeward subsidiary heat exchange subsection (12*b*). The refrigerant that has passed through the leeward subsidiary heat exchange subsection (12*b*) is guided through the lower portion of the connecting header (24) to the windward subsidiary heat exchange subsection (11*b*). The refrigerant that has passed through the windward subsidiary heat exchange subsection (11*b*) flows out of the heat exchanger (100) through the lower portion of the inlet/outlet header (21) and the refrigerant flow divider (20) to the liquid refrigerant pipe (31). In the course of such refrigerant flow, the refrigerant radiates heat through heat exchange with outdoor air.

In the heat exchanger (100), the windward heat exchange section (11) and the leeward heat exchange section (12) of the heat exchange part (10) respectively forming the plurality of (in these embodiments, two) rows are each divided into two upper and lower columns, i.e., the main heat exchange subsection (11*a*), (12*a*) and the subsidiary heat exchange subsection (11*b*), (12*b*). These main and subsidiary heat exchange subsections communicate with one another through the intermediate header (22) or the intermediate communication pipe (23), for example. This configuration is merely an example. For example, the windward heat exchange section (11) and the leeward heat exchange section (12) do not have to be each divided into upper and lower subsections. This eliminates the need for the intermediate header (22), the intermediate communication pipe (23), and other similar members.

In the heat exchanger (100), the heat transfer tubes (13) arranged in multiple columns along the predetermined tube column direction (in these embodiments, the vertical direction) are arranged in two rows adjacent to each other in a staggered manner along the tube row direction (in these embodiments, the direction in which outdoor air passes through the heat exchange part (10)) that intersects each of the tube column direction and the longitudinal direction of the heat transfer tubes (13). This configuration is merely an example. The heat transfer tubes (13) may be arranged in three or more rows. In this case, an intermediate header (22), a connecting header (24), and other similar members need to be added as appropriate in accordance with the arrangement of the heat transfer tubes (13) and the routing of paths of the heat transfer tubes (13), and need to be each connected to the associated longitudinal end portions of the heat transfer tubes (13).

Detailed Configuration of Connecting Header

Figure 3:
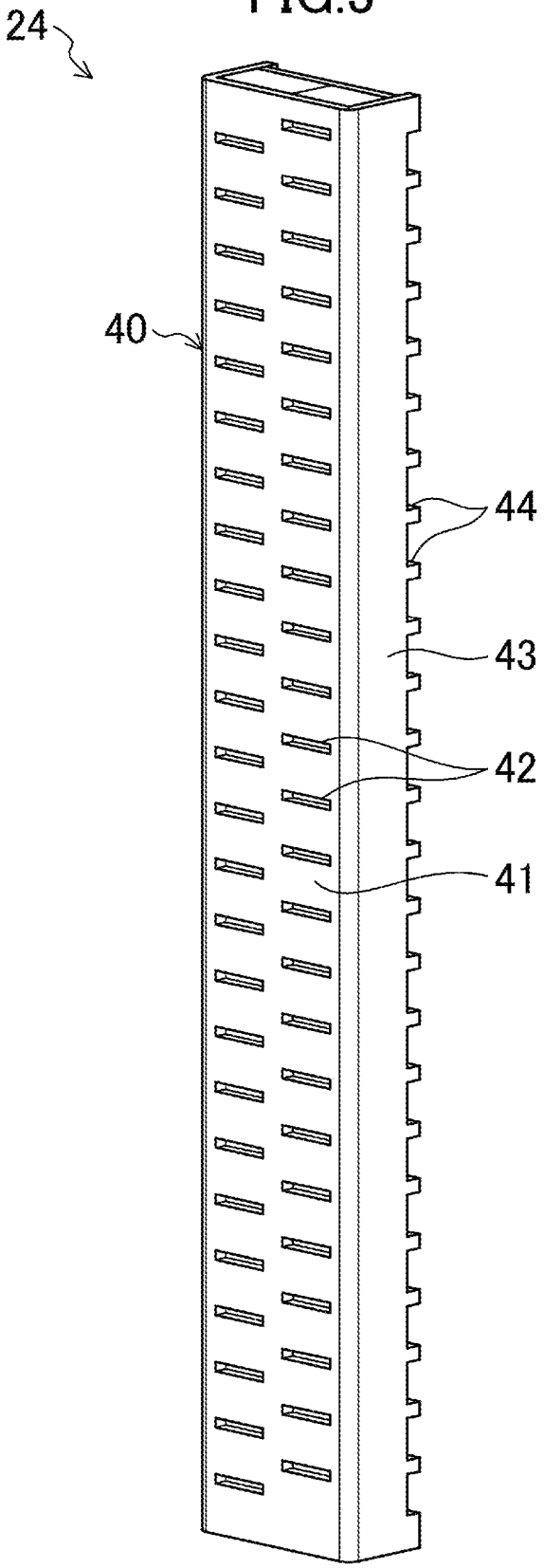
FIG. 3 is an enlarged perspective view of a connecting header of the heat exchanger illustrated in FIG. 1.
Figure 4:
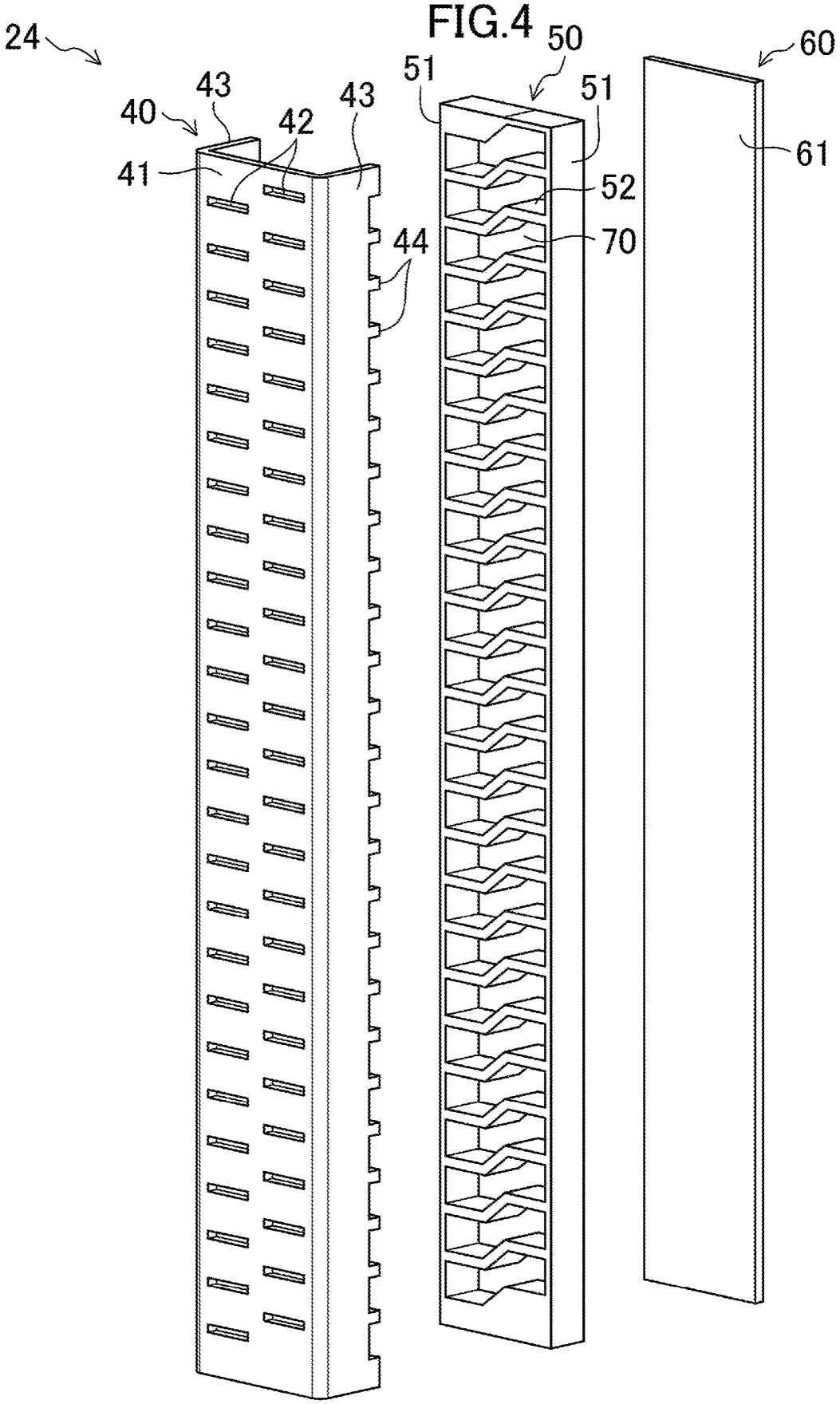
FIG. 4 is an exploded perspective view of the connecting header of the heat exchanger illustrated in FIG. 1.
Figure 5:
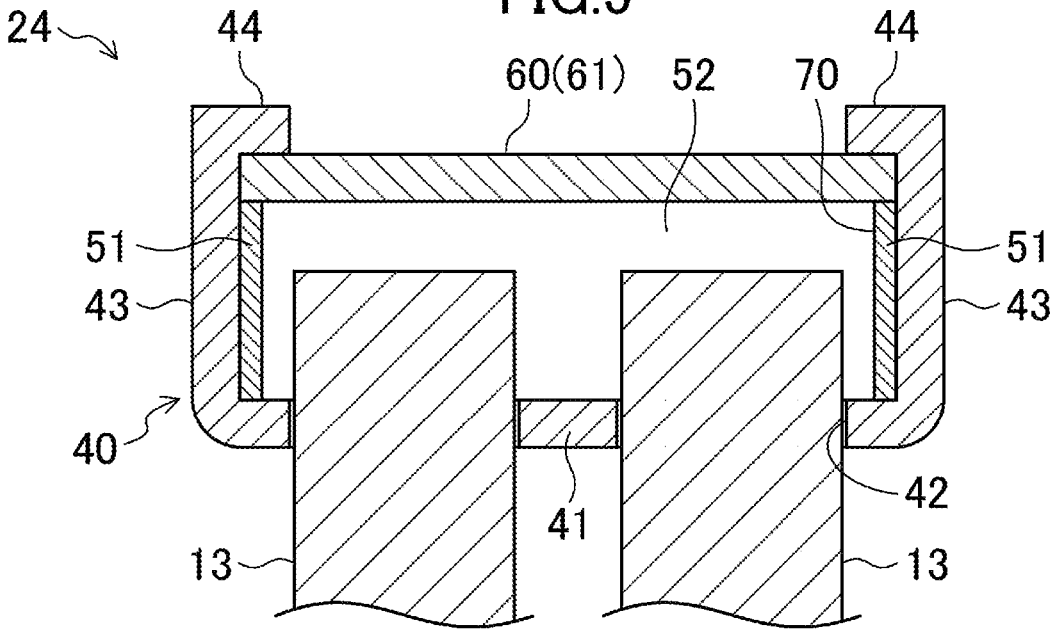
FIG. 5 is a planar cross-sectional view of the connecting header of the heat exchanger illustrated in FIG. 1.
Figure 6:
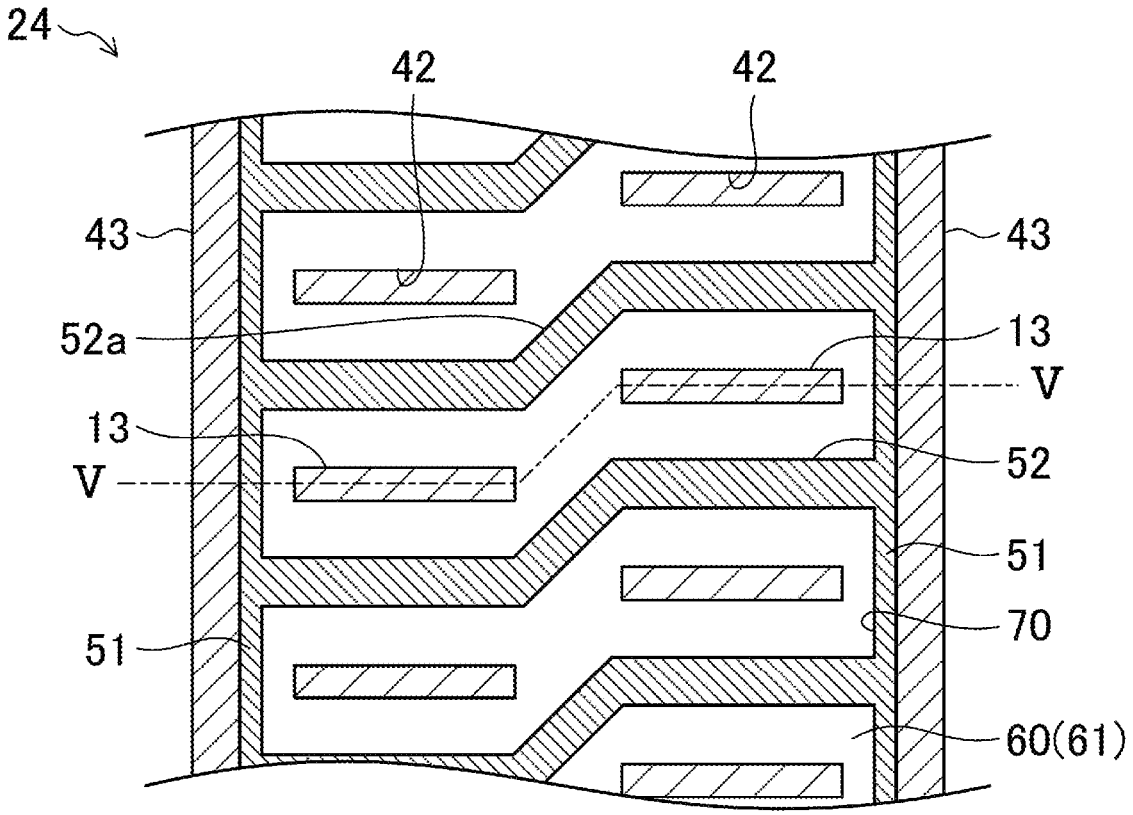
FIG. 6 is a longitudinal sectional view of the connecting header of the heat exchanger illustrated in FIG. 1, the view being taken along the width of the connecting header.

FIGS. 3, 4, 5, and 6 are respectively an enlarged perspective view, an exploded perspective view, a planar cross-sectional view, and a longitudinal sectional view of the connecting header (24). The longitudinal sectional view is taken along the width of the connecting header (24). FIG. 5 is the cross-sectional view taken along line V-V in FIG. 6. FIGS. 3 and 4 illustrate a state in which the heat transfer tubes (13) have not been inserted into the connecting header (24). FIGS. 5 and 6 illustrate a state in which the heat transfer tubes (13) have been inserted into the connecting header (24). In the following description, a direction perpendicular to the longitudinal direction of the connecting header (24) and also perpendicular to the longitudinal direction of the heat transfer tubes (13) is referred to as the "width direction of the connecting header (24)" (abbreviated also as the "header width direction").

As illustrated in FIGS. 3 and 4, the connecting header (24) includes a first member (40), a second member (50), and a third member (60), which are sequentially stacked.

The first member (40) includes a main wall portion (41) having a plurality of through holes (42) through each of which the first longitudinal end portion of an associated one of the heat transfer tubes (13) passes, and a pair of outer side plates (43) extending from both ends of the main wall portion (41) in the header width direction to the third member (60) in the longitudinal direction of the heat transfer tubes (13). The through holes (42) are arranged in a plurality of (e.g., two) rows adjacent to each other in a staggered manner along the header width direction in accordance with the arrangement of the heat transfer tubes (13). The distal end portions of the pair of outer side plates (43) each have a plurality of press-fit claws (44). The outer side plates (43) each having the press-fit claws (44) may be integrated with the main wall portion (41) by pressing, for example.

The second member (50) defines a plurality of insertion spaces (70) each communicating with the first longitudinal end portions of the associated heat transfer tubes (13). Specifically, the second member (50) includes a pair of side plates (51) defining the insertion spaces (70) therebetween in the header width direction, and at least one (in these embodiments, a plurality of) partition plate (52) connected to the pair of side plates (51) to separate the insertion spaces (70) from each other. The side plates (51) and the at least one partition plate (52) may be integrated together by, for example, extrusion molding, cutting, or 3D processing.

The third member (60) is configured as a flat plate (61) facing the first longitudinal end portions of the heat transfer tubes (13) that have respectively passed through the through holes (42). In these embodiments, the third member (60), i.e., the flat plate (61), closes the sides of the insertion spaces (70) remote from the main wall portion (41) of the first member (40). In other words, the third member (60) opposes the main wall portion (41) across the insertion spaces (70).

In these embodiments, as illustrated in FIG. 5, press-fitting the press-fit claws (44) of the first member (40) to the surface of the third member (60) remote from the second member (50) allows the connecting header (24) including the stacked first, second, and third members (40), (50), and (60) to be fixed. Here, each side plate (51) of the second member (50) is covered with an associated one of the outer side plates (43) of the first member (40) from outside in the header width direction. The side plates (51) and at least one partition plate (52) of the second member (50) each have two end surfaces that are respectively in contact with the main wall portion (41) of the first member (40) and the third member (60) (the flat plate (61)).

In these embodiments, as illustrated in FIG. 6, the at least one partition plate (52) of the second member (50) has a step (52*a*) adapted to the staggered arrangement of the through holes (42) of the first member (40), i.e., the heat transfer tubes (13). Thus, the insertion spaces (70) each overlap two of the through holes (42) which are arranged side by side in the header width direction (tube row direction) and which vary in their positions in the tube column direction. In other words, the insertion spaces (70) each communicate with the first longitudinal end portions of two associated ones of the heat transfer tubes (13) which are arranged side by side in the tube row direction and which vary in their positions in the tube column direction.

Detailed Configuration of Inlet/Outlet Header

Figure 7:
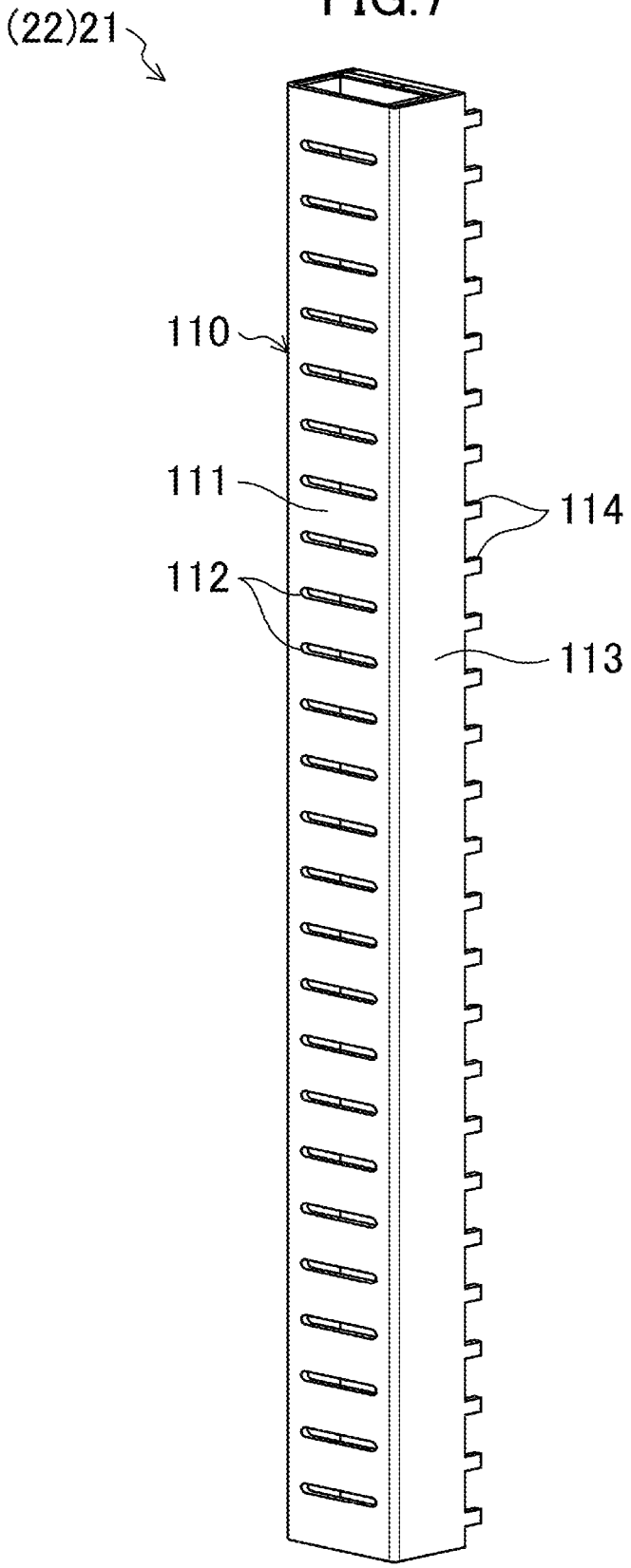
FIG. 7 is an enlarged perspective view of an inlet/outlet header of the heat exchanger illustrated in FIG. 1.
Figure 8:
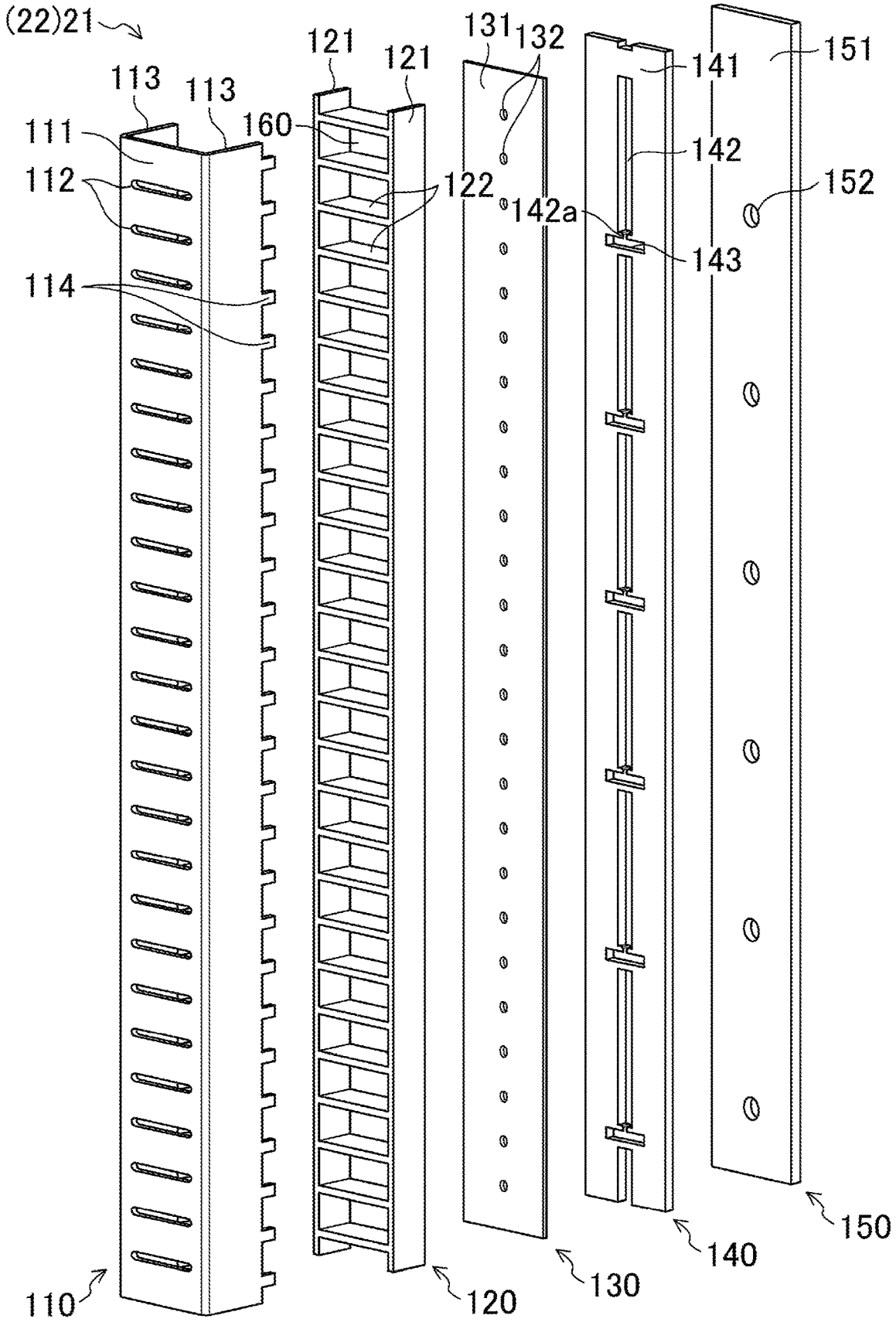
FIG. 8 is an exploded perspective view of the inlet/outlet header of the heat exchanger illustrated in FIG. 1.
Figure 9:
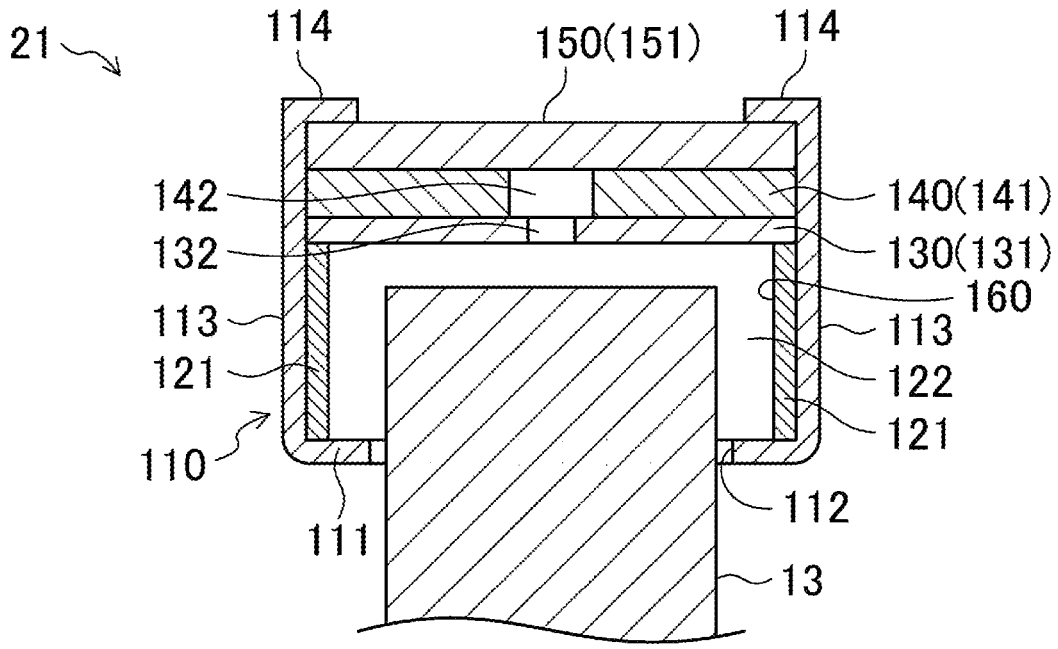
FIG. 9 is a planar cross-sectional view of the inlet/outlet header of the heat exchanger illustrated in FIG. 1.
Figure 10:
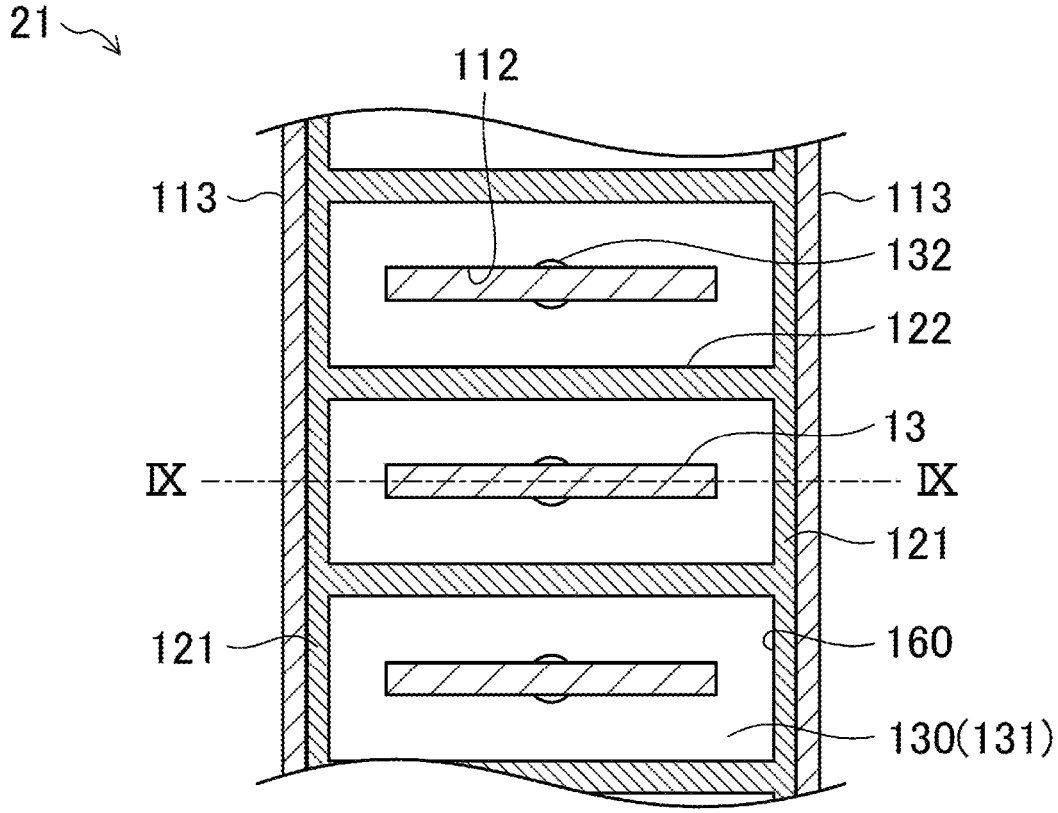
FIG. 10 is a longitudinal sectional view of the inlet/outlet header of the heat exchanger illustrated in FIG. 1, the view being taken along the width of the inlet/outlet header.

FIGS. 7, 8, 9, and 10 are respectively an enlarged perspective view, an exploded perspective view, a planar cross-sectional view, and a longitudinal sectional view of the inlet/outlet header (21). The longitudinal sectional view is taken along the width of the inlet/outlet header (21). FIG. 9 is the cross-sectional view taken along line IX-IX in FIG. 10. FIGS. 7 and 8 illustrate a state in which the heat transfer tubes (13) have not been inserted into the inlet/outlet header (21). FIGS. 9 and 10 illustrate a state in which the heat transfer tubes (13) have been inserted into the inlet/outlet header (21). In the following description, a direction perpendicular to the longitudinal direction of the inlet/outlet header (21) and also perpendicular to the longitudinal direction of the heat transfer tubes (13) is referred to as the "width direction of the inlet/outlet header (21)" (abbreviated also as the "header width direction").

FIGS. 7 to 10 illustrate the structure of the lower portion of the inlet/outlet header (21) connected to the refrigerant flow divider (20). Adjusting the configuration of a main channel (fourth and fifth members (140) and (150) described below), i.e., the positions, shapes, and other features of the main channel and openings through the periphery of the header, allows the upper portion of the inlet/outlet header (21) and the intermediate header (22) to also have basically the same structure as that illustrated in FIGS. 7 to 10.

As illustrated in FIGS. 7 and 8, the inlet/outlet header (21) includes a first member (110), a second member (120), a third member (130), a fourth member (140), and a fifth member (150), which are sequentially stacked.

The first member (110) includes a main wall portion (111) having a plurality of through holes (112) through each of which the first longitudinal end portion of an associated one of the heat transfer tubes (13) passes, and a pair of outer side plates (113) extending from both ends of the main wall portion (111) in the header width direction to the fifth member (150) in the longitudinal direction of the heat transfer tubes (13). The heat transfer tubes (13) arranged in one row along the tube column direction are respectively inserted into the through holes (112). The distal end portions of the pair of outer side plates (113) each have a plurality of press-fit claws (114). The outer side plates (113) each having the press-fit claws (114) may be integrated with the main wall portion (111) by pressing, for example.

The second member (120) defines a plurality of insertion spaces (160) each communicating with the first longitudinal end portion of an associated one of the heat transfer tubes (13). Specifically, the second member (120) includes a pair of side plates (121) defining the insertion spaces (160) therebetween in the header width direction, and at least one (in these embodiments, a plurality of) partition plate (122) connected to the pair of side plates (121) to separate the insertion spaces (160) from each other. The side plates (121) and the at least one partition plate (122) may be integrated together by, for example, extrusion molding, cutting, or 3D processing.

The third member (130) is configured as a flat plate (131) facing the first longitudinal end portions of the heat transfer tubes (13) that have respectively passed through the through holes (112). In these embodiments, the flat plate (131) has a plurality of holes (132) respectively overlapping the insertion spaces (160).

The fourth member (140) is configured as a flat plate (141) disposed on the side of the third member (130) remote from the heat transfer tubes (13). In these embodiments, the flat plate (141) has at least one main channel (142) overlapping the holes (132) of the third member (130), and at least one connection hole (143) connected to the main channel (142). Here, instead of providing one main channel (142) common to all of the columns, one of a plurality of main channels (142) and one of a plurality of connection holes (143) may be arranged for every predetermined number of columns (see FIG. 8).

The fifth member (150) is configured as a flat plate (151) disposed on the side of the fourth member (140) remote form the heat transfer tubes (13). In these embodiments, the flat plate (151) has a plurality of openings (152) respectively overlapping the connection holes (143) of the fourth member (140). The openings (152) are respectively connected to end portions of the refrigerant flow divider (20).

In these embodiments, as illustrated in FIG. 9, press-fitting the press-fit claws (114) of the first member (110) to the surface of the fifth member (150) remote from the fourth member (140) allows the inlet/outlet header (21) including the stacked first, second, third, fourth, and fifth members (110), (120), (130), (140), and (150) to be fixed. Here, each side plate (121) of the second member (120) is covered with an associated one of the outer side plates (113) of the first member (110) from outside in the header width direction. The side plates (121) and at least one partition plate (122) of the second member (120) each have two end surfaces that are respectively in contact with the main wall portion (111) of the first member (110) and the third member (130) (the flat plate (131)).

In these embodiments, as illustrated in FIG. 10, the insertion spaces (160) correspond one to-one to the through holes (112) of the first member (110). In other words, the insertion spaces (160) each communicate with the first longitudinal end portion of an associated one of the heat transfer tubes (13). Thus, a refrigerant can be exchanged between the heat transfer tubes (13) and the refrigerant flow divider (20) through the insertion spaces (160), the holes (132) of the third member (130), a combination of the at least one main channel (142) and the at least one connection hole (143) of the fourth member (140), and the openings (152) of the fifth member (150).

Advantages of Embodiments

The heat exchanger (100) of these embodiments includes the heat transfer tubes (13) arranged in multiple columns along a predetermined direction, and the headers (21, 24) each configured to retain the first or second longitudinal end portions of the heat transfer tubes (13). Each header (21, 24) includes the first member (40, 110) including the main wall portion (41, 111) having the through holes (42, 112) through each of which the associated longitudinal end portion of an associated one of the heat transfer tubes (13) passes, the second member (50, 120) defining the insertion spaces (70, 160) each communicating with the associated longitudinal end portion(s) of the associated heat transfer tube(s) (13), and the third member (60, 130) facing the associated longitudinal end portions of the heat transfer tubes (13) that have respectively passed through the through holes (42, 112). The second member (50, 120) includes the pair of side plates (51, 121) defining the insertion spaces (70, 160) therebetween in the width direction of the header (21, 24), and the at least one partition plate (52, 122) connected to the pair of side plates (51, 121) to separate the insertion spaces (70, 160) from each other. As can be seen, the at least one partition plate (52, 122) of the second member (50, 120) that separates the insertion spaces (70, 160) from each other is supported by the side plates (51, 121) of the second member (50, 120) from both sides of the header (21, 24). This can reduce the deformation of the members that are being press-fitted together. This makes it difficult to form a gap between the first member (40, 110) into each of which the associated end portions of the heat transfer tubes (13) are inserted and the second member (50, 120). That is to say, a structure having the insertion spaces (70, 160) separated from each other can be achieved.

In the heat exchanger (100) of these embodiments, if not a heat sink member extruded in the direction of wind (in the widthwise direction of the flat tubes) as in the known art but a member extruded in the axial direction of the heat transfer tubes (13) is used as the second member (50) forming part of the connecting header (24), the insertion spaces (70) can be easily separated from each other to accommodate the heat transfer tubes (13) arranged in a staggered manner as well. In other words, the shape of the second member (50) extruded can be adjusted so as to easily accommodate various arrangements, such as a staggered arrangement. This improves the degree of flexibility in features of paths (such as the number of tube columns and the number of the heat transfer tubes communicating with each of the insertion spaces (70)) and the ease of assembly of the heat exchanger (100).

In the heat exchanger (100) of these embodiments, integration of the pair of side plates (51, 121) and at least one partition plate (52, 122) of the second member (50, 120) makes it more difficult for the second member (50, 120) to be deformed.

In the heat exchanger (100) of these embodiments, the third member (60) forming part of the connecting header (24) closes the sides of the insertion spaces (70) remote from the main wall portion (41) of the first member (40), and the insertion spaces (70) each communicate with the first longitudinal end portions of two associated ones of the heat transfer tubes (13). Thus, the connecting header (24) functions as an interrow refrigerant turning-back part. In this case, the heat transfer tubes (13) are arranged in two rows in a staggered manner in the width direction of the header (24). This can enhance the heat exchange performance of the heat exchanger (100).

In the heat exchanger (100) of these embodiments, the inlet/outlet header (21) further includes the fourth member (140) disposed on the side of the third member (130) remote from the heat transfer tubes (13) and defining the at least one main channel (142). The third member (130) has the holes (132) connecting the insertion spaces (160) and the at least one main channel (142) together. Thus, the inlet/outlet header (21) functions as a refrigerant inflow part or a refrigerant outflow part.

In the heat exchanger (100) of these embodiments, each pair of outer side plates (43, 113) respectively covering the side plates (51, 121) of the second member (50, 120) from outside in the header width direction are provided. This makes it more difficult for the second member (50, 120) to be deformed. Here, the outer side plates (43, 113) each have the press-fit claws (44, 114). Thus, the members can be press-fitted together using the press-fit claws (44, 114). Further, integration of the outer side plates (43, 113) as portions of the first member (40, 110) with the main wall portion (41, 111) can reduce the number of constituent members of the header.

In addition, in the heat exchanger (100) of these embodiments, the heat transfer tubes (13) configured as flat tubes can increase the heat transfer areas of the heat transfer tubes (13) to enhance the heat exchange performance.

Comparative Example

Figure 11:
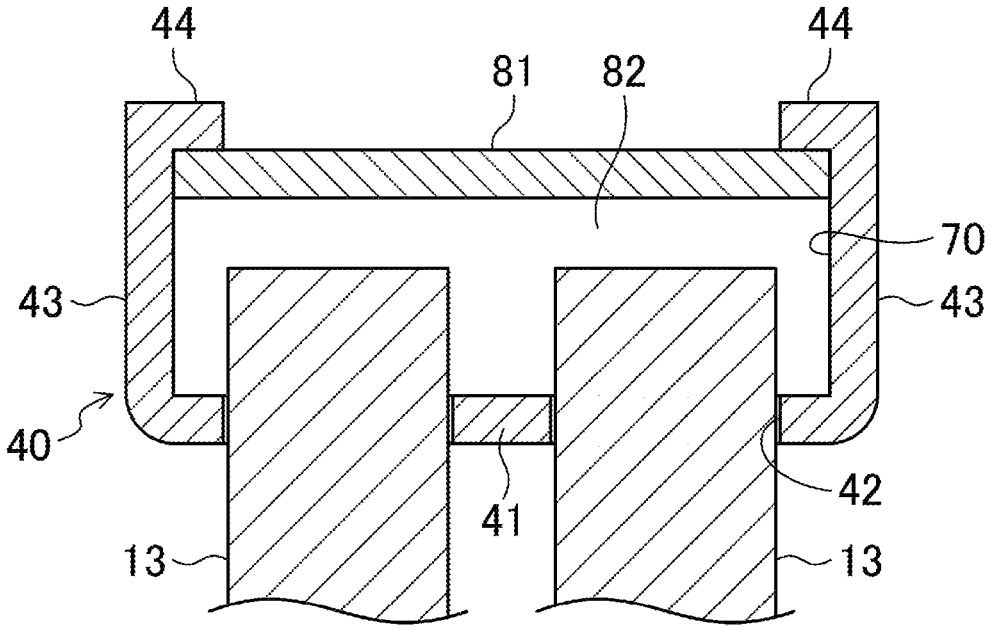
FIG. 11 is a planar cross-sectional view of a connecting header according to a comparative example.
Figure 12:
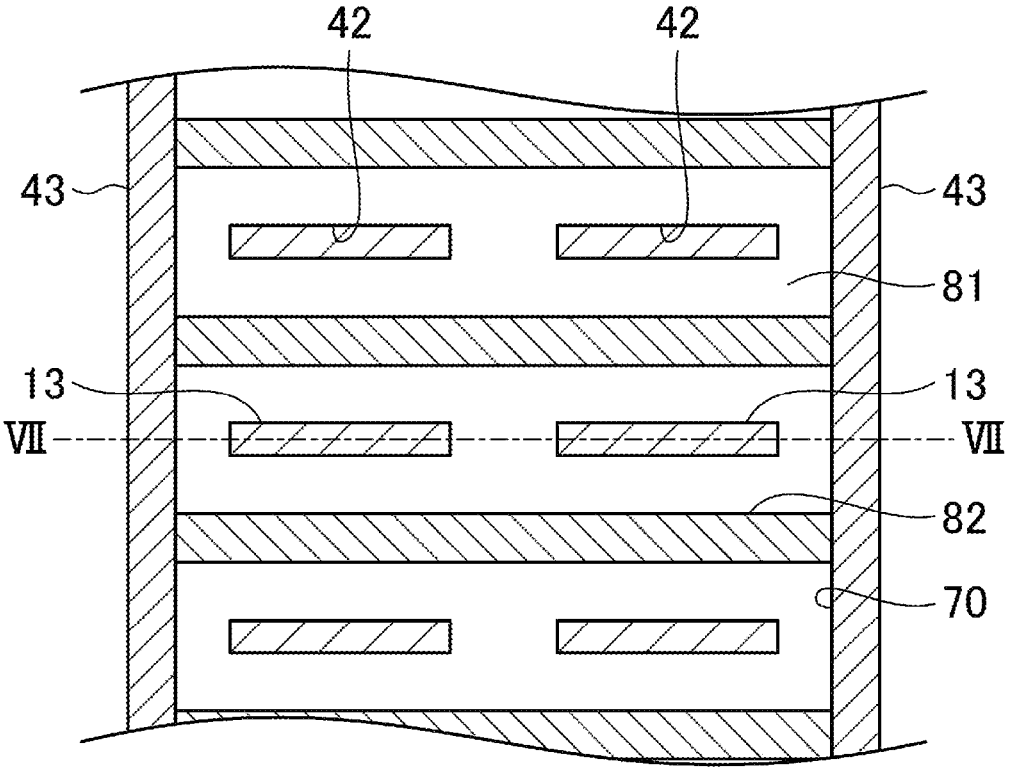
FIG. 12 is a longitudinal sectional view of the connecting header according to the comparative example, the view being taken along the width of the connecting header.
Figure 13:
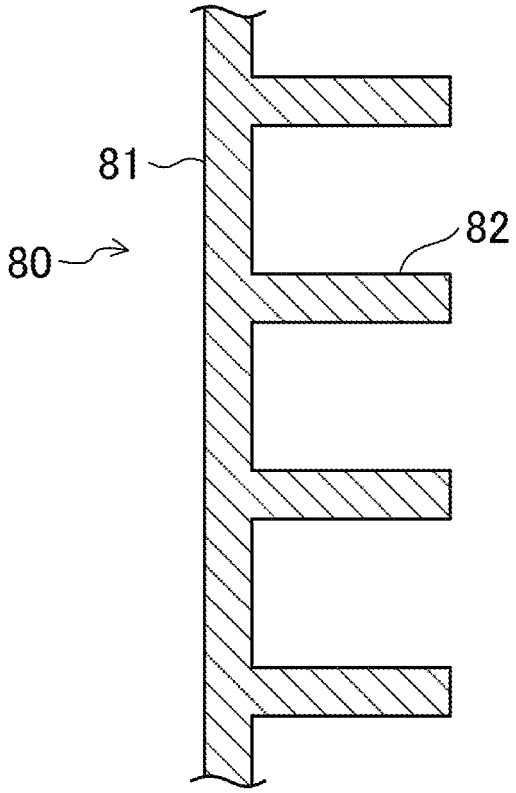
FIG. 13 is a longitudinal sectional view of a member of the connecting header of the comparative example defining insertion spaces, the view being taken along the longitudinal direction of heat transfer tubes.

FIG. 11 is a planar cross-sectional view of a connecting header according to a comparative example. FIG. 12 is a longitudinal sectional view of the connecting header according to the comparative example, the view being taken along the width of the connecting header. FIG. 13 is a longitudinal sectional view of a member of the connecting header of the comparative example defining insertion spaces, the view being taken along the longitudinal direction of heat transfer tubes. It should be noted that, in FIGS. 11 and 12, the same reference characters are used to designate the same elements as those in the embodiments illustrated in FIGS. 5 and 6.

The connecting header of the comparative example illustrated in FIGS. 11 to 13 is distinct from the connecting header (24) illustrated in FIGS. 5 and 6 in that instead of the second and third members (50) and (60) of the embodiments, a heat sink member (80) is used as a member defining insertion spaces (70). Specifically, the heat sink member (80) includes a flat plate portion (81) that closes the sides of the insertion spaces (70) remote from a main wall portion (41) of a first member (40), and at least one (in this comparative example, a plurality of) partition plate (82) that extends from the flat plate portion (81) to the main wall portion (41) of the first member (40) to separate the insertion spaces (70) from each other.

In this comparative example, when press-fit claws (44) of the first member (40) are press-fitted to the back surface of the heat sink member (80) (the flat plate portion (81)) to form the connecting header, the flat plate portion (81) is warped. As a result, the partition plate (82) cannot come into adequate contact with the main wall portion (41) of the first member (40). In other words, a gap is formed between the heat sink member (80) and the first member (40). This makes it difficult to separate the insertion spaces (70) from each other.

In this comparative example, the heat sink member (80) is extruded in the header width direction (wind direction). In other words, the partition plate (82) is extruded in the tube row direction. This makes it difficult to accommodate arrangements in columns separated from each other at positions varying among rows, such as a staggered arrangement, in high-volume machining.

Variations

FIGS. 14 to 19 are each a longitudinal sectional view of a connecting header according to a variation, the view being taken along the width of the connecting header. It should be noted that, in FIGS. 14 to 19, the same reference characters are used to designate the same elements as those in the embodiments illustrated in FIG. 6.

In the connecting header (24) of the embodiments illustrated in FIG. 6, the refrigerant flow is turned back between the two rows in which the heat transfer tubes (13) are arranged in a staggered manner along the header width direction. However, this configuration is merely an example. For example, the configuration of a connecting header illustrated in each of FIGS. 14 to 19 can also provide the same advantages as those of the foregoing embodiments.

Figure 14:
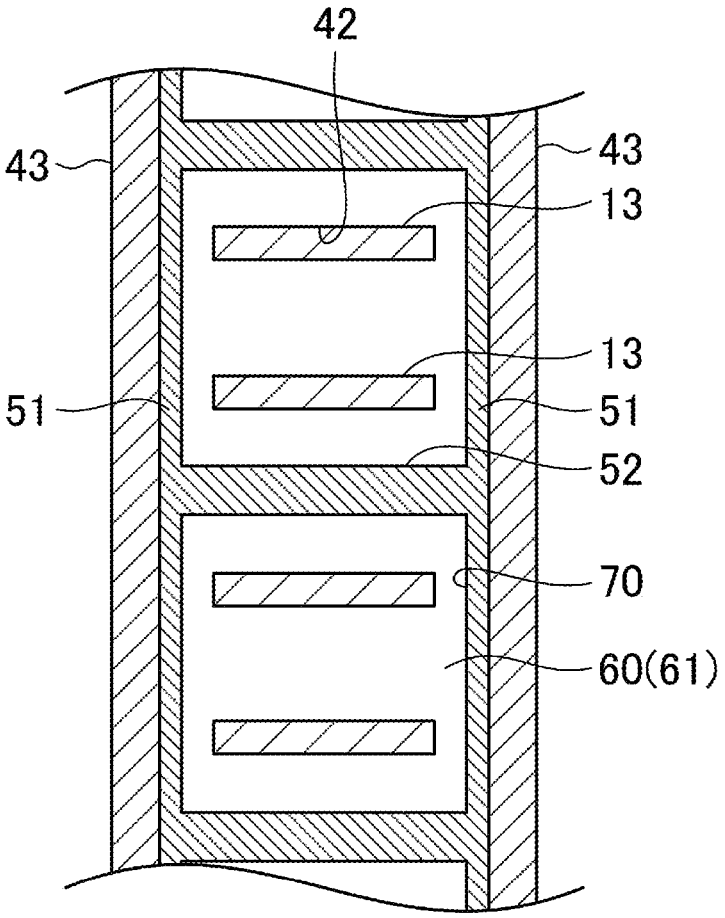
FIG. 14 is a longitudinal sectional view of a connecting header according to a variation, the view being taken along the width of the connecting header.

Specifically, as illustrated in, for example, FIG. 14, the connecting header may be configured such that the heat transfer tubes (13) are arranged in one row in the tube column direction and the end portions of two of the heat transfer tubes (13) adjacent to each other in the tube column direction communicate with the associated insertion space (70).

Figure 15:
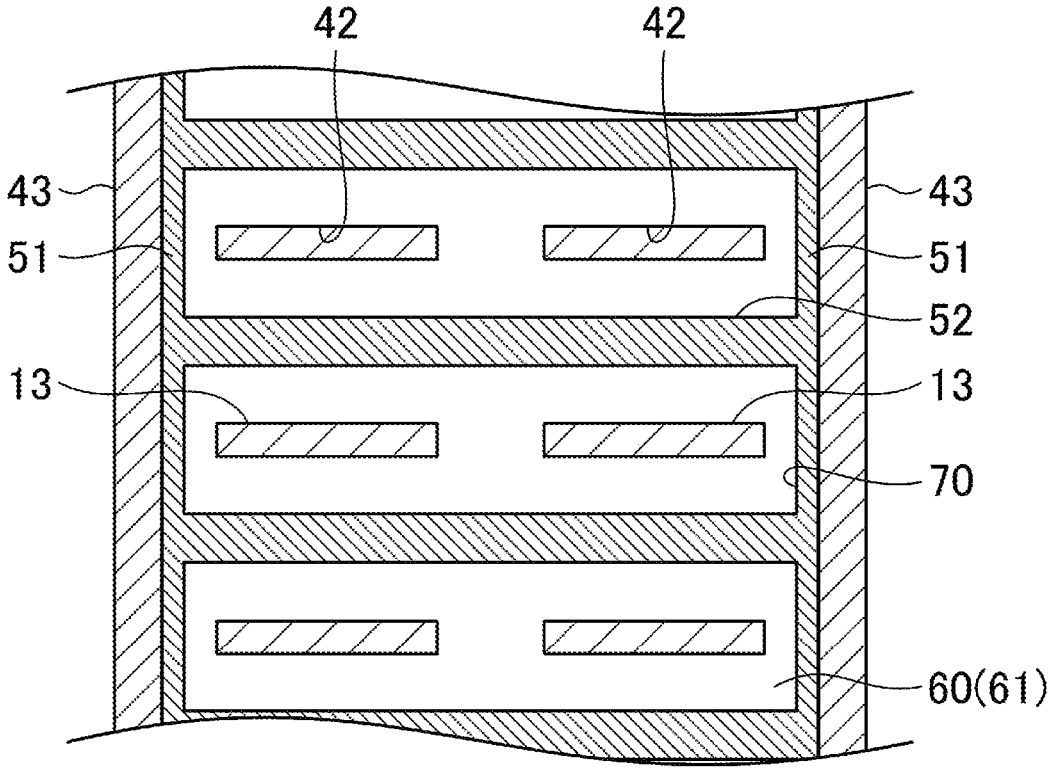
FIG. 15 is a longitudinal sectional view of a connecting header according to another variation, the view being taken along the width of the connecting header.

Alternatively, as illustrated in, for example, FIG. 15, the connecting header may be configured such that the heat transfer tubes (13) are arranged in two rows in parallel in the header width direction and the end portions of two of the heat transfer tubes (13) adjacent to each other in the header width direction communicate with the associated insertion space (70).

Figure 16:
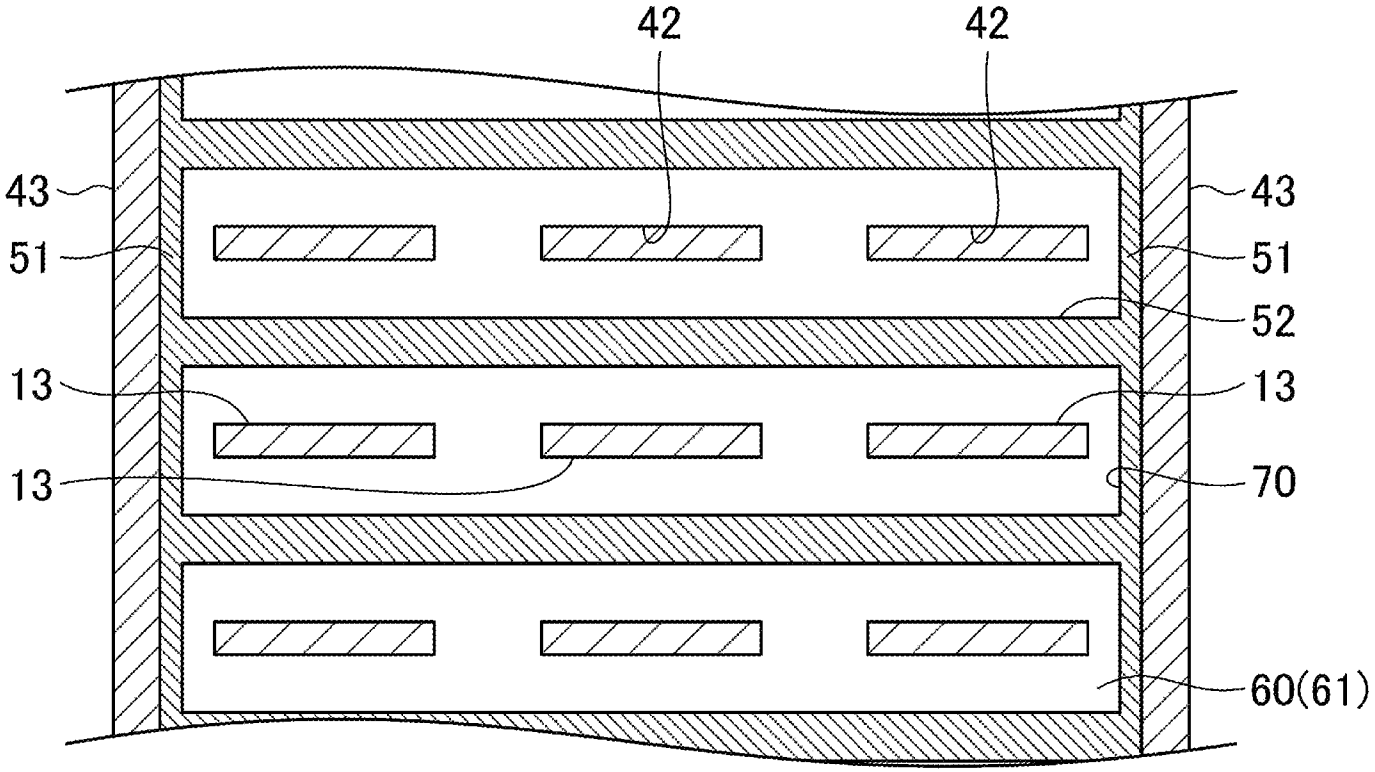
FIG. 16 is a longitudinal sectional view of a connecting header according to still another variation, the view being taken along the width of the connecting header.
Figure 17:
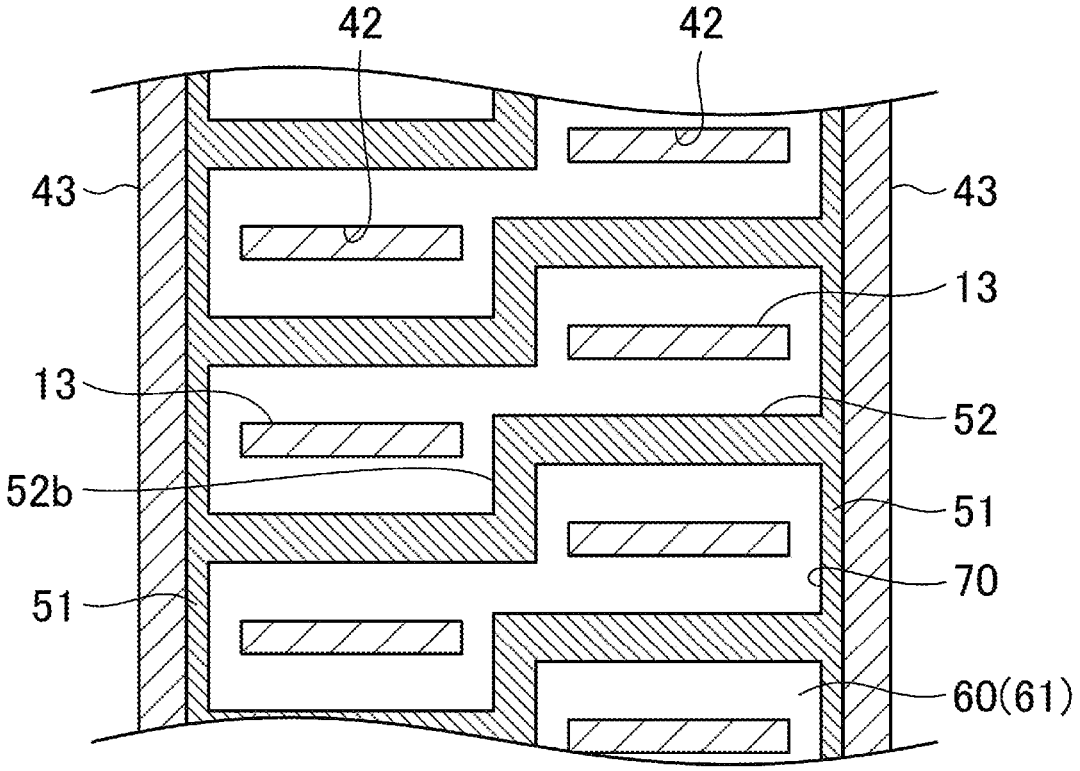
FIG. 17 is a longitudinal sectional view of a connecting header according to yet another variation, the view being taken along the width of the connecting header.

Still alternatively, as illustrated in, for example, FIG. 16, the connecting header may be configured such that the heat transfer tubes (13) are arranged in three rows in parallel in the header width direction and the end portions of three of the heat transfer tubes (13) adjacent to one another in the header width direction communicate with the associated insertion space (70). In this case, a refrigerant that has flowed into the connecting header through one of the three heat transfer tubes (13) may be delivered into the other two heat transfer tubes (13). This can reduce pressure loss.

The at least one partition plate (52) of the second member (50) of the connecting header (24) of the embodiments illustrated in FIG. 6 has the step (52*a*) obliquely inclined so as to be adapted to the staggered arrangement of the heat transfer tubes (13). Alternatively, as illustrated in, for example, FIG. 17, the at least one partition plate (52) may have a perpendicular step (52*b*). This can reduce the dimension of the connecting header in the header width direction.

Figure 18:
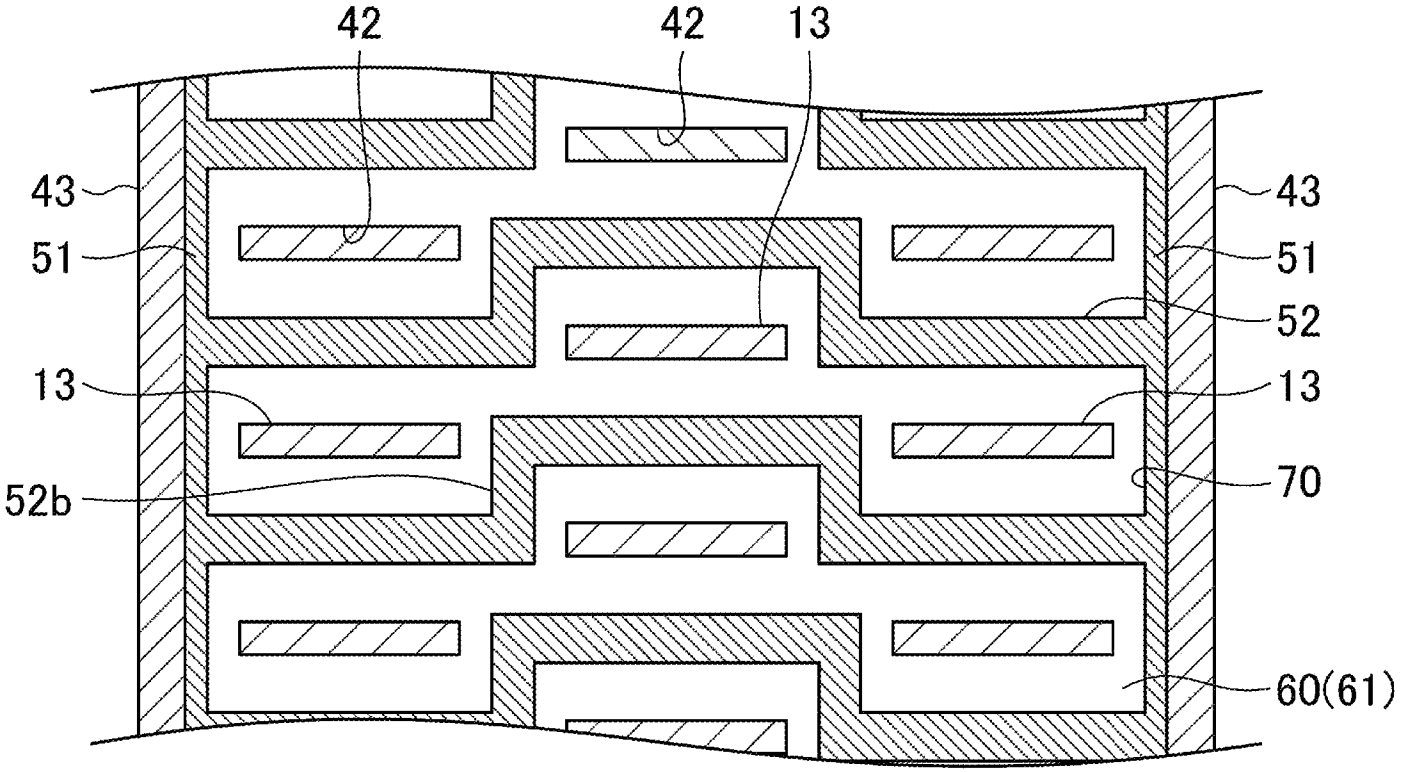
FIG. 18 is a longitudinal sectional view of a connecting header according to a further variation, the view being taken along the width of the connecting header.

Still alternatively, as illustrated in, for example, FIG. 18, the connecting header may be configured such that the heat transfer tubes (13) are arranged in three rows in a staggered manner in the header width direction and the end portions of three of the heat transfer tubes (13) adjacent to one another in the header width direction communicate with the associated insertion space (70). In this case, a refrigerant that has flowed into the connecting header through one of the three heat transfer tubes (13) may be delivered into the other two heat transfer tubes (13). This can reduce pressure loss. The at least one partition plate (52) of the second member (50) may have a perpendicular step (52*b*) adapted to the staggered arrangement of the heat transfer tubes (13). This can reduce the dimension of the connecting header in the header width direction.

Figure 19:
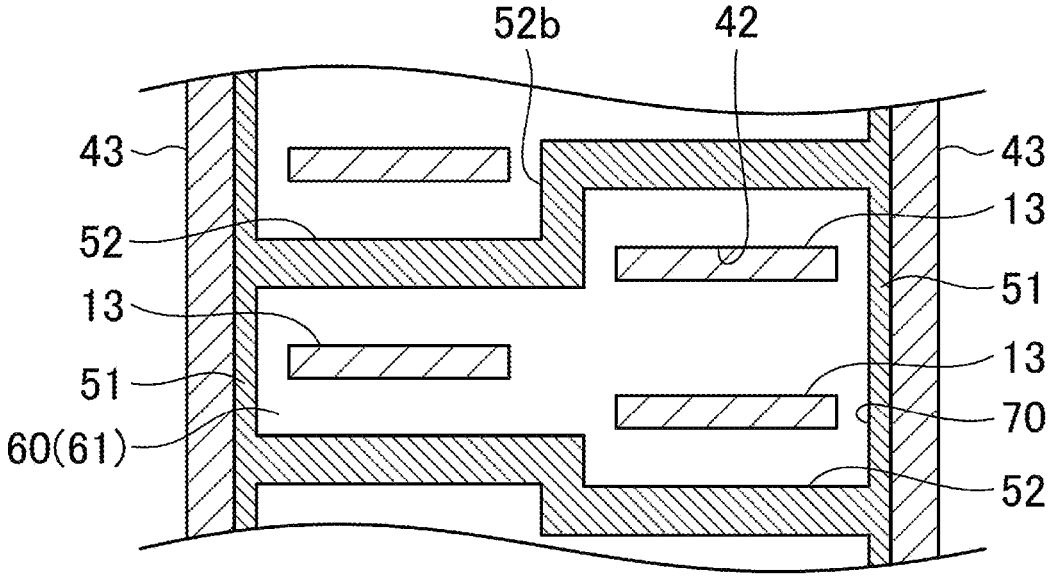
FIG. 19 is a longitudinal sectional view of a connecting header according to a further variation, the view being taken along the width of the connecting header.

Still alternatively, as illustrated in, for example, FIG. 19, the connecting header may be configured such that the heat transfer tubes (13) are arranged in two rows in a staggered manner in the header width direction and the end portions of three of the heat transfer tubes (13) adjacent to one another in the header width direction communicate with the associated insertion space (70). In this case, a refrigerant that has flowed into the connecting header through one of the three heat transfer tubes (13) may be delivered into the other two heat transfer tubes (13). This can reduce pressure loss. The at least one partition plate (52) of the second member (50) may have a perpendicular step (52*b*) adapted to the staggered arrangement of the heat transfer tubes (13). This can reduce the dimension of the connecting header in the header width direction.

Other Embodiments

In the foregoing embodiments (including the variations), the second member (50, 120) includes the pair of side plates (51, 121) defining the insertion spaces (70, 160) therebetween in the width direction of the header (21, 24), and the at least one partition plate (52, 122) separating the insertion spaces (70, 160) from each other.

Figure 20:
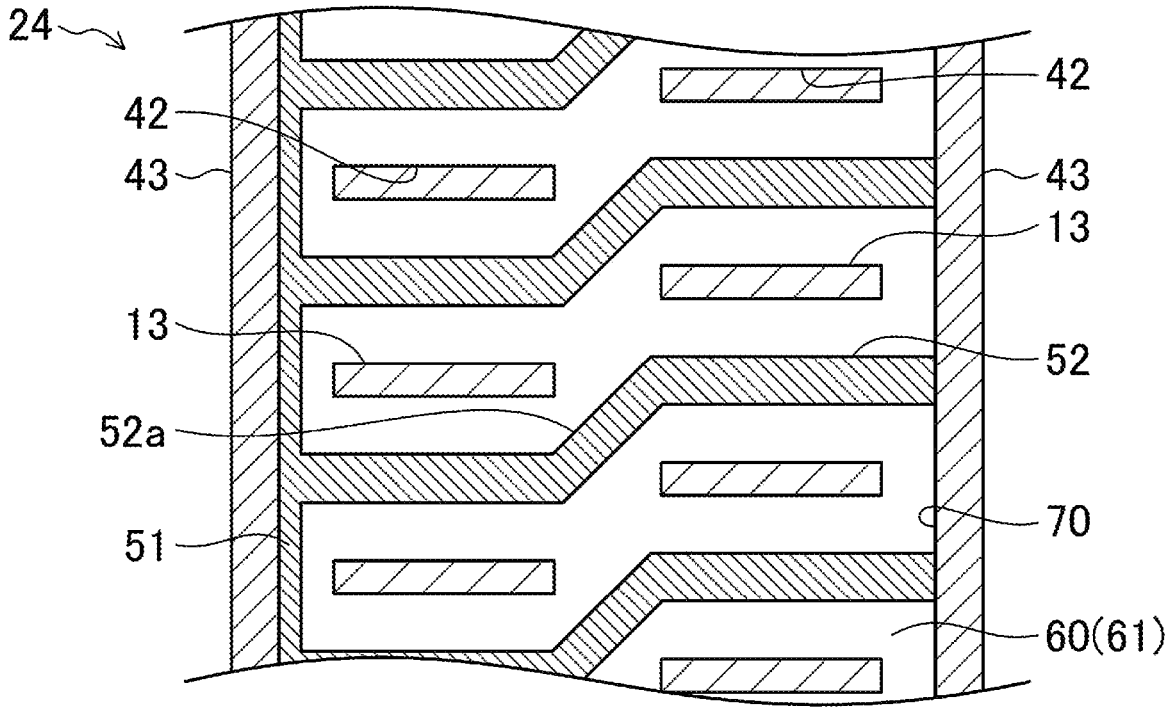
FIG. 20 is a longitudinal sectional view of a connecting header according to a further variation, the view being taken along the width of the connecting header.

However, for example, just like the connecting header (24) illustrated in FIG. 20, a second member (50) may include a side plate (51) defining first sides (the left sides in this case) of the insertion spaces (70) in the header width direction, and at least one partition plate (52) separating the insertion spaces (70) from each other. One of outer side plates (43) of a first member (40) may define second sides (the right sides in this case) of the insertion spaces (70) in the header width direction. Here, the side plate (51) and the at least one partition plate (52) may be integrated together. It should be noted that, in FIG. 20, the same reference characters are used to designate the same elements as those in the embodiments illustrated in FIG. 6.

Figure 21:
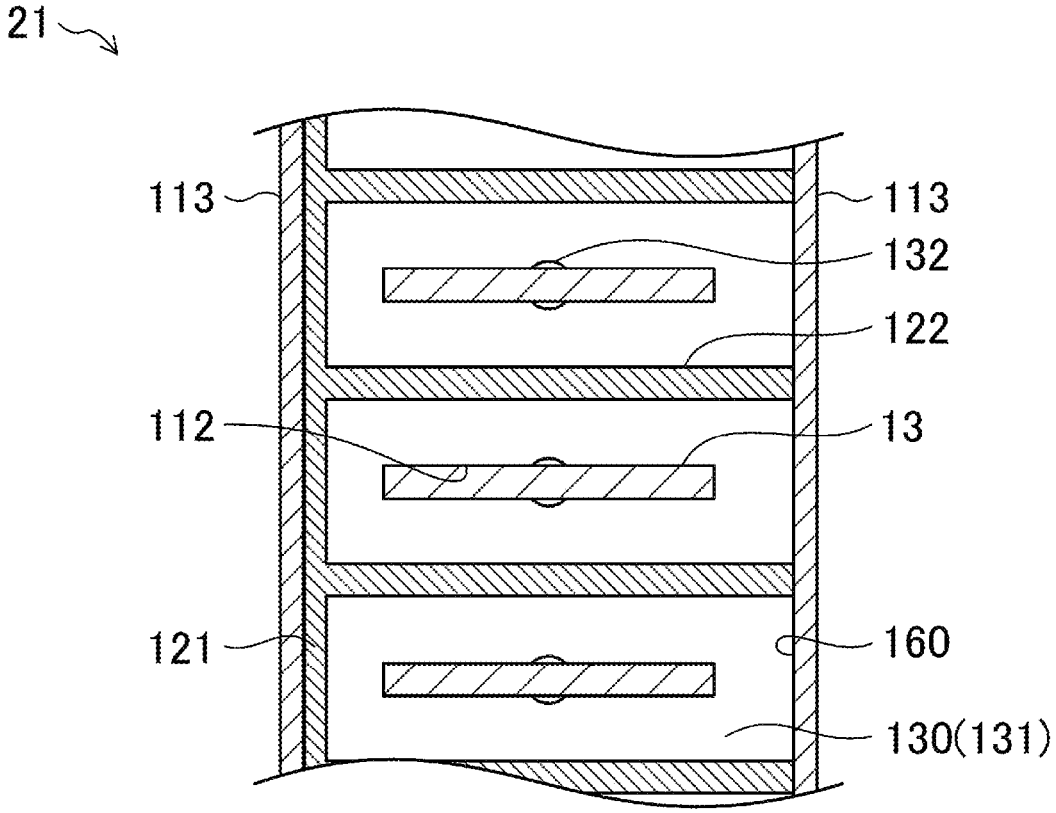
FIG. 21 is a longitudinal sectional view of an inlet/outlet header according to a further variation, the view being taken along the width of the inlet/outlet header.

Alternatively, for example, just like the inlet/outlet header (21) illustrated in FIG. 21, a second member (120) may include a side plate (121) defining first sides (the left sides in this case) of the insertion spaces (160) in the header width direction, and at least one partition plate (122) separating the insertion spaces (160) from each other. One of outer side plates (113) of a first member (110) may define second sides (the right sides in this case) of the insertion spaces (160) in the header width direction. Here, the side plate (121) and the at least one partition plate (122) may be integrated together. It should be noted that, in FIG. 21, the same reference characters are used to designate the same elements as those in the embodiments illustrated in FIG. 10.

In the foregoing embodiments (including the variations), the pair of side plates (51, 121) and the at least one partition plate (52, 122) of each header (21, 24) are integrated together. Alternatively, the side plates (51, 121) and the at least one partition plate (52, 122) may be configured as separate members, which may be then joined together.

In the foregoing embodiments (including the variations), the pair of side plates (51, 121) of each header (21, 24) are covered with the pair of outer side plates (43, 113) from outside in the header width direction. Alternatively, the pair of outer side plates (43, 113) do not have to be provided.

In the foregoing embodiments (including the variations), the pair of outer side plates (43, 113) of each header (21, 24) each have the press-fit claws (44, 114). Alternatively, another one of the header members may have press-fit claws.

In the foregoing embodiments (including the variations), the pair of outer side plates (43, 113) of each header (21, 24) are integrated, as portions of the first member (40, 110), with the main wall portion (41, 111). Alternatively, the pair of outer side plates (43, 113) may be separate from the first member (40, 110).

In the foregoing embodiments (including the variations), flat tubes are used as the heat transfer tubes (11). Alternatively, other tubes, such as circular tubes, may be used.

Figure 22:
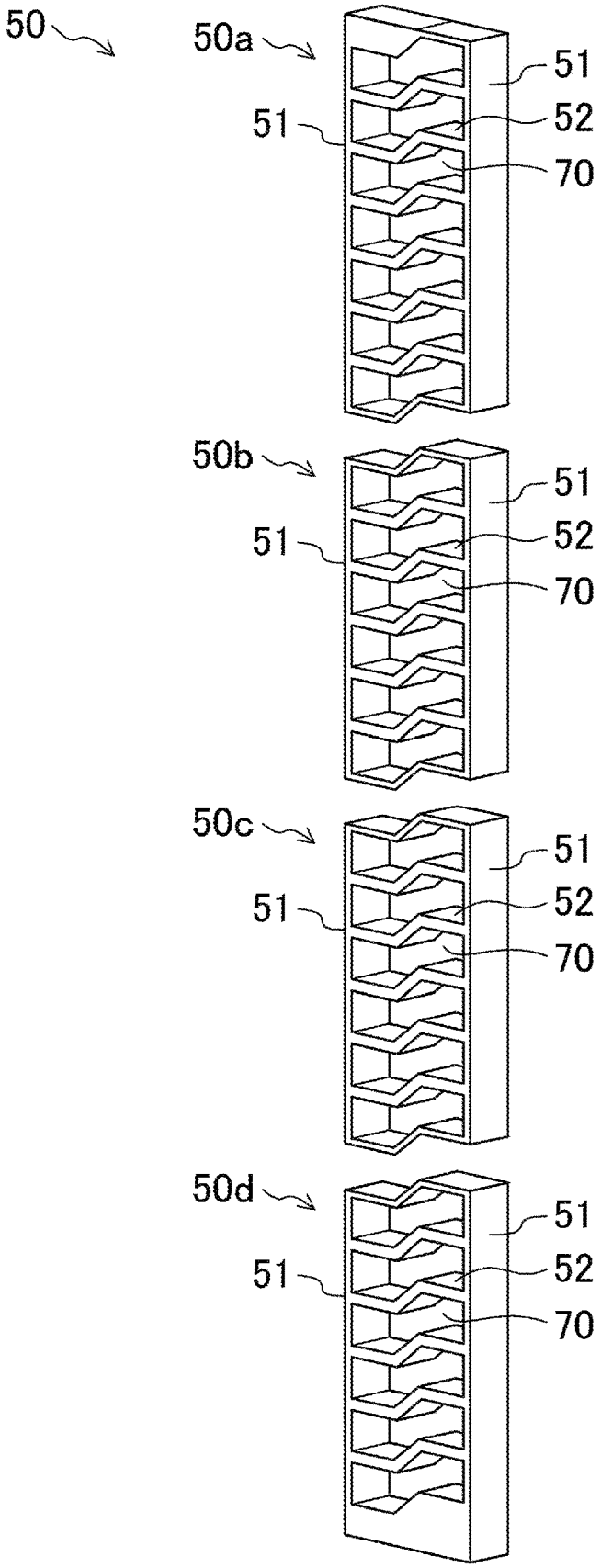
FIG. 22 is a perspective view of a second member of a connecting header according to a further variation.
Figure 23:
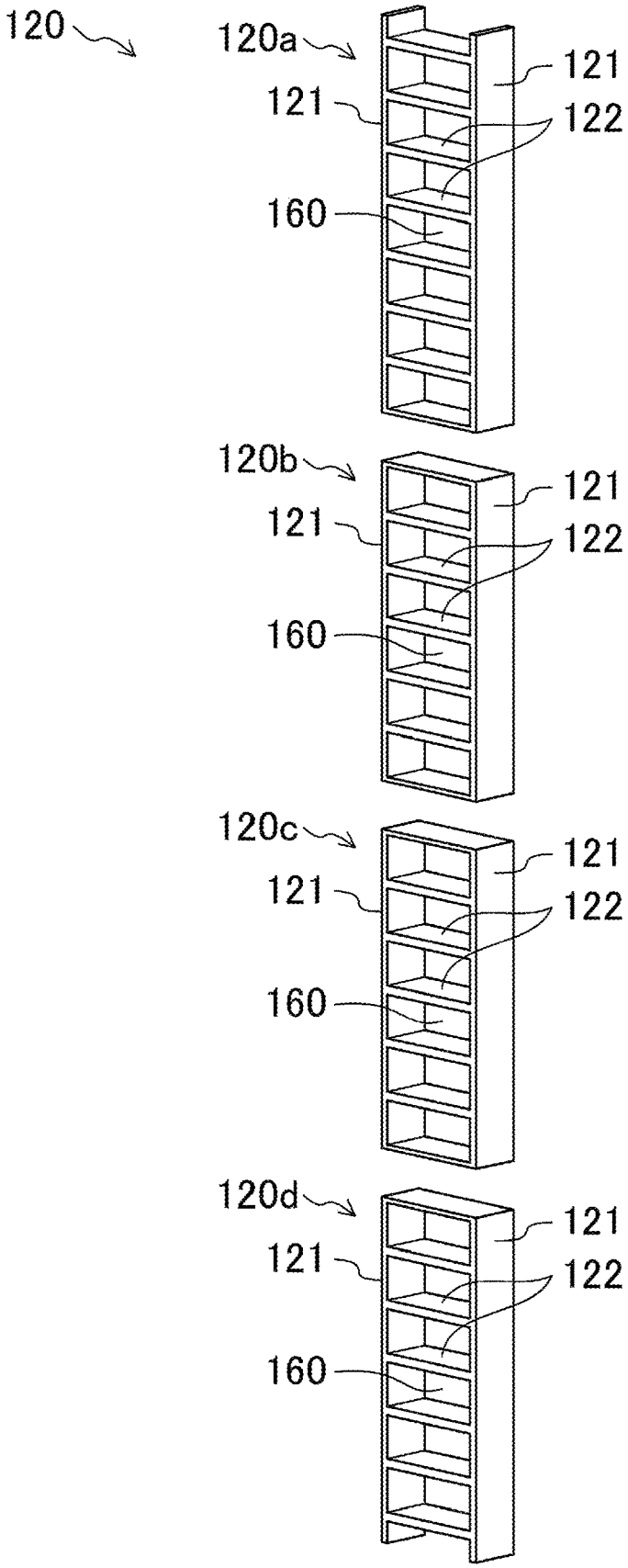
FIG. 23 is a perspective view of a second member of an inlet/outlet header according to a further variation.

In the foregoing embodiments (including the variations), the third member (60, 130) and other similar members of each header (21, 24) are configured as flat plates. However, the shapes of header members should not be specifically limited. Each header (21, 24) may be divided into a plurality of blocks in the tube column direction. As illustrated in, for example, FIG. 22, the second member (50) of the connecting header (24) may include a plurality of separate blocks (in FIG. 22, four blocks 50*a* to 50*d*) joined together along the tube column direction. Alternatively, as illustrated in, for example, FIG. 23, the second member (120) of the inlet/outlet header (21) may include a plurality of separate blocks (in FIG. 23, four blocks 120*a* to 120*d*) joined together along the tube column direction. This allows the size of a die for use in extrusion to be smaller, and allows the length of a cut surface to be less, if the second member (50, 120) of each header (21, 24) is machined by, for example, extrusion molding or cutting, than if the entire second member (50, 120) is configured as an integral member. This can improve the ease of volume production to reduce the cost of machining. Here, the number of the blocks forming the second member (50, 120) should not be specifically limited, and merely needs to match the size of the header (21, 24) in the tube column direction.

In the foregoing embodiments (including the variations), the inlet/outlet header (21) has the structure illustrated in FIGS. 7 to 10. A flow dividing header or a carbon dioxide refrigerant header may have the same structure.

In the foregoing embodiments (including the variations), the features of the present invention are shared by both of the inlet/outlet header (21) and the connecting header (24). Alternatively, either the inlet/outlet header (21) or the connecting header (24) may have the features of the present invention.

A situation where the outdoor unit of the air conditioner includes the heat exchanger (100) as an outdoor heat exchanger has been described in the foregoing embodiments (including the variations). However, the type of a heat exchanger to which the present invention is to be applied, a place where the heat exchanger is installed, and other features should not be specifically limited.

The present disclosure is useful for a heat exchanger.

Although the disclosure has been described with respect to only a limited number of embodiments, those skilled in the art, having benefit of this disclosure, will appreciate that various other embodiments may be devised without departing from the scope of the present disclosure.

REFERENCE SIGNS LIST

10 Heat Exchange Part
11 Windward Heat Exchange Section
11*a* Windward Main Heat Exchange Subsection
11*b* Windward Subsidiary Heat Exchange Subsection
12 Leeward Heat Exchange Section
12*a* Leeward Main Heat Exchange Subsection
12*b* Leeward Subsidiary Heat Exchange Subsection
13 Heat Transfer Tube
14 Flat Surface
15 Internal Channel
16 Heat Transfer Fin
17 Cut-out
20 Refrigerant Flow Divider
21 Inlet/Outlet Header
22 Intermediate Header
23 Intermediate Communication Pipe
24 Connecting Header
31 Liquid Refrigerant Pipe
32 Gas Refrigerant Pipe
40 First Member
41 Main Wall Portion
42 Through Hole
43 Outer Side Plate
44 Press-fit Claw
50 Second Member
51 Side Plate
52 Partition Plate
60 Third Member
61 Flat Plate
70 Insertion Space
100 Heat Exchanger
110 First Member
111 Main Wall Portion
112 Through Hole
113 Outer Side Plate
114 Press-fit Claw
120 Second Member
121 Side Plate
122 Partition Plate
130 Third Member
131 Flat Plate
132 Hole
140 Fourth Member
141 Flat Plate
142 Main Channel
143 Connection Hole
150 Fifth Member
151 Flat Plate
152 Opening
160 Insertion Space

What is claimed is:

1. A heat exchanger comprising:
heat transfer tubes disposed along a predetermined direction; and
a header that retains longitudinal ends of the heat transfer tubes, wherein
the header comprises:
a first member comprising a main wall portion that has through holes through which the longitudinal ends respectively pass;
a second member defining insertion spaces that communicate with the heat transfer tubes at the longitudinal ends; and
a third member facing the longitudinal ends,
the second member comprises:
a pair of side plates disposed in a width direction of the header and that define the insertion spaces therebetween; and
partition plates, each connected to the pair of side plates, that separate adjacent ones of the insertion spaces,
the pair of side plates are spaced apart from the heat transfer tubes,
the insertion spaces are individually separated from each other by the partition plates,
the heat exchanger further comprises a pair of outer side plates respectively covering the pair of side plates from outside in the width direction of the header, and
the second member is thicker in a longitudinal direction of the heat transfer tubes than is the third member.

2. The heat exchanger of claim 1, wherein the partition plates are integrated with the pair of side plates.

3. The heat exchanger of claim 1, wherein
the third member opposes the main wall portion and closes sides of the insertion spaces, and
each of the insertion spaces communicates with at least two of the heat transfer tubes at the longitudinal ends.

4. The heat exchanger of claim 3, wherein
the heat transfer tubes are arranged in two or more rows in the width direction of the header, and
the heat transfer tubes of one row are staggered with respect to the heat transfer tubes of a next row.

5. The heat exchanger of claim 1, wherein
the header further comprises a fourth member that comprises a main channel and is disposed on one side of the third member,
the heat transfer tubes are disposed on another side of the third member, and
the third member has holes each communicating the main channel with one of the insertion spaces.

6. The heat exchanger of claim 1, wherein the pair of outer side plates comprise press-fit claws.

7. The heat exchanger of claim 1, wherein
the first member comprises the pair of outer side plates, and
the pair of outer side plates are integrated with the main wall portion.

8. The heat exchanger of claim 1, wherein the heat transfer tubes are flat tubes.

9. The heat exchanger of claim 1, wherein the second member comprises blocks joined together along the predetermined direction.

10. A heat exchanger comprising:
heat transfer tubes disposed along a predetermined direction;
a header that retains longitudinal ends of the heat transfer tubes; and
an outer side plate, wherein
the header comprises:
a first member comprising a main wall portion that has through holes through each of which the longitudinal ends respectively pass;

a second member defining insertion spaces that communicate with the heat transfer tubes at the longitudinal ends; and a third member facing the longitudinal ends, the second member comprises:

a side plate defining first sides of the insertion spaces in a width direction of the header; and a partition plate connected to the side plate and that separates adjacent ones of the insertion spaces, the outer side plate defines second sides of the insertion spaces that oppose the first sides in the width direction of the header, and the partition plate is in direct contact with the outer side plate.

11. The heat exchanger of claim 10, wherein the side plate is integrated with the partition plate.

12. The heat exchanger of claim 10, wherein the heat transfer tubes are flat tubes.

13. The heat exchanger of claim 10, wherein the second member comprises blocks joined together along the predetermined direction.

* * * * *